US011278068B2

(12) United States Patent
Pasko

(10) Patent No.: US 11,278,068 B2
(45) **Date of Patent: *Mar. 22, 2022**

(54) DISPOSABLE MEDICAL GOWN

(71) Applicant: Medline Industries, LP, Northfield, IL (US)

(72) Inventor: Stephanie Pasko, Des Plaines, IL (US)

(73) Assignee: Medline Industries LP, Northfield, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/882,455

(22) Filed: May 23, 2020

(65) Prior Publication Data

US 2020/0281287 A1 Sep. 10, 2020

Related U.S. Application Data

(63) Continuation of application No. 14/942,755, filed on Nov. 16, 2015, now abandoned, which is a (Continued)

(51) Int. Cl.
*A41D 13/12* (2006.01)
*A41F 1/00* (2006.01)

(52) U.S. Cl.
CPC ..... *A41D 13/1236* (2013.01); *A41D 13/12* (2013.01); *A41D 13/129* (2013.01); (Continued)

(58) Field of Classification Search
CPC .... A41D 13/1236; A41D 13/12; A41D 13/08; A41D 13/129; A41D 2300/33; (Continued)

(56) References Cited

U.S. PATENT DOCUMENTS 313,046 A 3/1885 Batdorf
371,353 A 10/1887 Perry
(Continued)

FOREIGN PATENT DOCUMENTS

CA 2343482 10/2001
CA 2799116 8/2013
(Continued)

OTHER PUBLICATIONS

Bravo, Jocelyn M. , "NonFinal OA", U.S. Appl. No. 14/086,798; Filed Nov. 21, 2013; dated Dec. 11, 2019.
(Continued)

*Primary Examiner* — Sally Haden
(74) *Attorney, Agent, or Firm* — Philip H. Burrus, IV

(57) ABSTRACT

A disposable medical gown (100) includes a body covering portion (101) and optionally one or more sleeves (107,108). The body covering portion (101) defines a head insertion aperture (104) between a frontal body covering portion (103) configured to cover a frontal body portion of a wearer and a rear portion (203) configured to cover at least parts of shoulder blades of the wearer. A torso opening (201) is disposed on a side of the rear portion (203) opposite the head insertion aperture (104), and extends distally from the rear portion (203). One or more perforations (202) extend across the rear portion (203) at least partially between the torso opening (202) and the head insertion aperture (104), and facilitate easy removal of the gown (100). A user removes the gown (100) by pulling the front portion (103), thereby tearing the perforations. Elastic gatherings can be included to snug the gown about the torso or limbs of the user.

20 Claims, 27 Drawing Sheets

Related U.S. Application Data continuation of application No. 13/804,565, filed on Mar. 14, 2013, now Pat. No. 10,455,872, which is a continuation-in-part of application No. 13/276,232, filed on Oct. 18, 2011, now Pat. No. 10,441,010.

(52) U.S. Cl.
CPC ..... *A41D 13/1209* (2013.01); *A41F 1/00* (2013.01); *A41D 2300/33* (2013.01); *A41D 2400/44* (2013.01); *A41D 2400/52* (2013.01); *A41D 2500/30* (2013.01)

(58) Field of Classification Search
CPC ..... A41D 13/1209; A41D 2400/44; A41D 2400/52; A41D 2500/30; A41F 1/00
See application file for complete search history.

(56) References Cited

U.S. PATENT DOCUMENTS 842,224 A 1/1907 Mills
850,960 A 4/1907 O'Connoor
884,063 A 4/1908 Baldwin
1,506,332 A 8/1924 Bloom
1,980,435 A 11/1934 Reagan
D108,151 S 1/1938 Cairns
2,172,162 A 8/1939 Gillette
2,292,347 A 8/1942 Bailey
D136,385 S 9/1943 Pons
D136,386 S 9/1943 Pons
2,374,643 A 5/1945 Boettcher
D146,506 S 3/1947 Kenny
2,430,941 A 11/1947 Long
2,431,466 A 11/1947 Barri
2,449,584 A 9/1948 Briton
2,556,931 A 6/1951 Miller
2,653,324 A 8/1953 McMahon
2,664,570 A 1/1954 Artzt
2,668,294 A 2/1954 Gilpin
2,673,347 A 3/1954 Weiss
2,825,902 A 3/1958 Breier
2,971,198 A 2/1961 Tomich
D193,132 S 7/1962 Rhoads et al.
3,129,432 A 4/1964 Belkin
3,130,462 A 4/1964 Mitchell
3,144,661 A 8/1964 Buser
3,229,305 A 1/1966 Nevitt
3,276,036 A 10/1966 Carter et al.
D208,527 S 9/1967 Grengg
3,359,569 A 12/1967 Scrivens
3,397,406 A 8/1968 Leach
3,399,406 A 9/1968 Bradley
3,429,433 A 2/1969 Holt
3,451,062 A 6/1969 Bradley
3,540,441 A 11/1970 Collins
3,625,206 A 12/1971 Charnley
3,696,443 A 10/1972 Taylor
3,707,964 A 1/1973 Patience et al.
3,719,955 A * 3/1973 Hrubecky ..... A41H 42/00 2/243.1
3,721,997 A 3/1973 Mundt
3,721,999 A 3/1973 Goya et al.
3,750,664 A 8/1973 Collins
3,803,640 A 4/1974 Ericson
3,824,625 A 7/1974 Green
D233,634 S 11/1974 Snider
3,858,243 A 1/1975 Pierron et al.
3,868,728 A 3/1975 Krzewinski
3,881,474 A 5/1975 Krzewinski
3,881,476 A 5/1975 Bolker et al.
D236,293 S 8/1975 Banks
3,921,221 A 11/1975 Zoephel
3,935,596 A 2/1976 Allen, Jr. et al.
3,952,373 A 4/1976 Noorily
3,956,048 A 5/1976 Nordgren
3,968,792 A 7/1976 Small
3,989,040 A 11/1976 Lofgren et al.
4,000,521 A 1/1977 Zoephel et al.
4,017,909 A 4/1977 Brandriff
4,040,124 A 8/1977 Zoephel
4,041,942 A 8/1977 Dougan et al.
4,119,093 A 10/1978 Goodman
4,119,095 A 10/1978 Lewis
4,134,398 A 1/1979 Scrivens
4,153,054 A 5/1979 Boone
4,171,542 A 10/1979 Cox et al.
D254,276 S 2/1980 Behrmann
4,214,320 A 7/1980 Belkin
RE30,520 E 2/1981 Pierron
4,266,663 A 5/1981 Geraci
4,290,148 A 9/1981 Roberts
4,308,864 A 1/1982 Small et al.
4,315,334 A 2/1982 Pearsall
4,323,062 A 4/1982 Canty
4,334,529 A 6/1982 Wirth
D267,830 S 2/1983 Arnseth et al.
4,384,573 A 5/1983 Elliott
4,408,357 A 10/1983 Toth
4,467,477 A 8/1984 DeGennaro
4,476,587 A 10/1984 Itoi
4,476,860 A 10/1984 Collins et al.
4,479,492 A 10/1984 Singer
4,489,720 A 12/1984 Morris et al.
4,504,977 A 3/1985 King et al.
4,523,335 A 6/1985 Scrivens
4,535,481 A 8/1985 Ruth-Larson et al.
4,553,538 A 11/1985 Rafelson
4,561,126 A 12/1985 Truman
4,569,341 A 2/1986 Morris
4,570,268 A 2/1986 Freeman
4,596,245 A 6/1986 Morris
4,616,642 A 10/1986 Martin et al.
4,622,699 A 11/1986 Spriggs
4,627,427 A 12/1986 Acro
4,631,756 A 12/1986 Scrivens
4,653,120 A 3/1987 Leaf
4,664,103 A 5/1987 Martin et al.
4,674,132 A 6/1987 Stein et al.
4,686,715 A 8/1987 Price
4,705,171 A 11/1987 Eldridge
4,711,236 A 12/1987 Glassman
4,718,124 A 1/1988 Sawicki et al.
4,736,467 A 4/1988 Schwarze et al.
4,745,915 A 5/1988 Enright et al.
4,783,854 A 11/1988 Bjorklund
4,829,602 A 5/1989 Harreld et al.
4,864,657 A 9/1989 Lake
4,869,271 A 9/1989 Idris
D305,376 S 1/1990 Russell
D305,575 S 1/1990 Gordon et al.
4,905,710 A 3/1990 Jones
4,920,578 A 5/1990 Janzen et al.
4,942,987 A 7/1990 Stackhouse
4,951,317 A 8/1990 Gray et al.
4,951,318 A 8/1990 Harreld et al.
4,964,173 A 10/1990 Gordon
4,969,215 A 11/1990 Burkett
5,010,592 A 4/1991 Skiles, Jr.
5,027,438 A 7/1991 Schwarze et al.
5,029,344 A 7/1991 Shannon et al.
5,033,115 A 7/1991 Bowling et al.
D319,113 S 8/1991 Adams
5,042,507 A 8/1991 Dowdy
5,061,246 A 10/1991 Anapliotis
5,063,919 A 11/1991 Silverberg
5,074,316 A 12/1991 Dowdy
5,088,116 A 2/1992 Gould
5,097,534 A 3/1992 Viemeister et al.
5,109,873 A 5/1992 Marshall
5,135,188 A 8/1992 Anderson et al.
5,136,758 A 8/1992 Wilcox et al.
5,140,996 A 8/1992 Sommers et al.
5,184,351 A 2/1993 Benstock
5,253,642 A 10/1993 Stackhouse et al.

(56) References Cited

U.S. PATENT DOCUMENTS 5,271,100 A 12/1993 Holt
D348,974 S 7/1994 Whitwill
D351,712 S * 10/1994 Jackson ..... D2/720
5,362,306 A 11/1994 McCarver et al.
5,372,589 A 12/1994 Davis
5,377,387 A 1/1995 Freed
D356,204 S 3/1995 Derrickson
5,410,758 A 5/1995 Dupont et al.
5,414,867 A 5/1995 Bowling et al.
5,417,225 A 5/1995 Rubenstein et al.
5,433,221 A 7/1995 Adair
5,444,871 A 8/1995 Lopez
5,444,872 A 8/1995 Johnson
5,444,873 A 8/1995 Levin
D362,331 S 9/1995 Berger, II
5,454,119 A 10/1995 Thomm
5,533,209 A 7/1996 Davis
D374,113 S 10/1996 Console
5,561,861 A 10/1996 Lopez et al.
5,575,006 A 11/1996 Wolfe
5,605,534 A 2/1997 Hutchison
5,611,356 A 3/1997 Rothrum
5,674,189 A 10/1997 McDowell et al.
5,694,643 A 12/1997 Fujiwara
5,707,703 A 1/1998 Rothrum et al.
5,765,566 A 6/1998 Rothrum
5,768,707 A 6/1998 Lederer
5,784,718 A 7/1998 Finnegan
5,806,094 A 9/1998 Kasun et al.
5,813,051 A 9/1998 Counter
5,813,052 A 9/1998 Taylor
5,816,253 A 10/1998 Sosabee
5,862,525 A 1/1999 Tankersley et al.
5,867,825 A 2/1999 Scheerer
5,916,202 A 6/1999 Haswell
5,973,450 A 10/1999 Nishizawa et al.
5,975,082 A 11/1999 Dowdy
5,985,395 A 11/1999 Comstock et al.
D419,748 S 2/2000 Sartori
6,049,907 A 4/2000 Palomo
6,062,444 A 5/2000 Tankersley et al.
6,105,579 A 8/2000 Levitt et al.
6,115,840 A 9/2000 Hastins
D431,344 S 10/2000 Briceno
6,138,278 A 10/2000 Taylor
6,196,033 B1 3/2001 Dowdle
6,216,270 B1 4/2001 Moquin et al.
6,235,659 B1 5/2001 McAmish et al.
6,244,268 B1 6/2001 Annett
6,272,685 B1 8/2001 Kumar
6,285,611 B1 9/2001 Kang
6,345,622 B1 2/2002 Chandler et al.
6,405,730 B2 2/2002 Levitt et al.
6,378,136 B2 8/2002 Matsushita
D463,093 S 9/2002 Murray
6,449,772 B1 9/2002 Donner et al.
D469,945 S 2/2003 Mayer
6,536,636 B1 3/2003 McDonniel
6,564,386 B2 5/2003 Fujikawa et al.
6,601,239 B2 8/2003 Drake
6,665,880 B2 12/2003 Poppe
6,694,981 B2 2/2004 Gingles et al.
6,742,522 B1 6/2004 Baker et al.
6,820,622 B1 11/2004 Teves et al.
6,843,252 B2 1/2005 Harrison et al.
6,990,686 B2 1/2006 Palmer
7,114,500 B2 10/2006 Bonutti
D533,982 S 12/2006 Graneto, III
7,181,773 B1 2/2007 Piraka
7,237,271 B1 7/2007 McLandrich
7,290,547 B2 11/2007 Joseph et al.
7,305,991 B2 12/2007 Santilli et al.
D563,627 S 3/2008 Warren
D565,279 S 4/2008 Ferrell
7,370,369 B2 5/2008 Cheung
7,412,728 B2 8/2008 Alesina et al.
D575,936 S 9/2008 Fenderson et al.
D579,178 S 10/2008 Snyder et al.
7,454,798 B2 11/2008 Feodoroff
D584,483 S 1/2009 Glynn
7,549,179 B1 6/2009 Saied
D598,638 S 8/2009 Graneto, III
7,594,279 B2 9/2009 Roy
D608,980 S 2/2010 Brady
7,654,266 B2 2/2010 Corbitt, Jr.
D612,126 S 3/2010 Milgrom
7,673,754 B2 3/2010 Wilson, Jr. et al.
D618,884 S 7/2010 Zhu
D622,479 S 8/2010 Herzog
D622,934 S 9/2010 Graneto, III
7,819,911 B2 10/2010 Anderson et al.
7,841,020 B2 11/2010 Mayfield et al.
7,926,120 B2 4/2011 Birmingham
7,971,274 B2 7/2011 Graneto, III
8,006,836 B2 8/2011 Trombetta
D646,463 S 10/2011 Petrovskis et al.
D647,688 S 11/2011 Hilgart
8,056,146 B2 11/2011 Porowski
8,069,495 B2 12/2011 Kemper
D653,019 S 1/2012 Bond
D655,479 S 3/2012 Umbach et al.
D657,530 S 4/2012 Farris et al.
8,162,137 B2 4/2012 Vellutato, Jr. et al.
8,286,263 B2 10/2012 Sampson-Howlett
8,332,965 B1 12/2012 Ryer
8,343,182 B2 1/2013 Kirkham
8,375,466 B2 2/2013 Tasezen et al.
D680,709 S 4/2013 Blood
8,464,374 B1 6/2013 Thayer
D687,209 S 8/2013 Levine
D690,078 S 9/2013 Anderson
D698,529 S 2/2014 Vanneste
8,677,513 B2 3/2014 Mathis et al.
D719,721 S 12/2014 Bonfiglio
D721,870 S 2/2015 Levine
D736,493 S 8/2015 Pasko
D737,546 S 9/2015 Sewall
D741,044 S 10/2015 Pasko
9,330,799 B1 5/2016 Phillips
D774,729 S 12/2016 Pasko
D779,155 S 2/2017 Pasko et al.
D779,156 S 2/2017 Pasko
D785,284 S 5/2017 Pasko
D787,780 S 5/2017 Pasko
D791,434 S 7/2017 Pasko
D792,056 S 7/2017 Reese et al.
9,808,319 B2 11/2017 Chua
D836,297 S 12/2018 Pasko
10,441,010 B2 10/2019 Pasko
2001/0032346 A1 10/2001 Matsushita et al.
2002/0095709 A1 7/2002 Fujikawa et al.
2003/0121522 A1 7/2003 Gingles et al.
2003/0131401 A1 7/2003 Dilworth
2004/0019951 A1 2/2004 Cioffi
2004/0103904 A1 6/2004 Auerbach et al.
2004/0123366 A1 7/2004 Schorr et al.
2004/0172734 A1 9/2004 Hartbrodt
2005/0044608 A1 3/2005 Ambrose et al.
2005/0132465 A1 6/2005 Kathumbi-Jackson et al.
2005/0145254 A1 7/2005 Aboul-Hosn et al.
2005/0223468 A1 10/2005 Hatton
2006/0000002 A1 1/2006 Bergkvist
2006/0064797 A1 3/2006 Pyeatt Rowe
2006/0081261 A1 4/2006 Corbin, Jr.
2006/0107434 A1 5/2006 Rowe
2006/0117452 A1 6/2006 Ambrose
2006/0117456 A1 6/2006 Griesbach
2006/0177655 A1 8/2006 Mizohata et al.
2006/0191541 A1 8/2006 Aboul-Hosn et al.
2006/0236440 A1 10/2006 Zahler
2006/0277655 A1 12/2006 Kerr
2006/0277668 A1 12/2006 Plut et al.
2006/0286334 A1 12/2006 Harpole
2007/0061940 A1 3/2007 Cazares

(56) References Cited

U.S. PATENT DOCUMENTS

| | | | |
|---|---|---|---|
| 2007/0102005 | A1 | 5/2007 | Bonutti |
| 2007/0130668 | A1 | 6/2007 | Berman et al. |
| 2008/0006279 | A1 | 1/2008 | Bodenham et al. |
| 2008/0023013 | A1 | 1/2008 | Tuke et al. |
| 2008/0047567 | A1 | 2/2008 | Bonutti |
| 2008/0115253 | A1 | 5/2008 | Gorman |
| 2008/0155728 | A1 | 7/2008 | Hafer et al. |
| 2008/0178365 | A1 | 7/2008 | Furgerson et al. |
| 2009/0165186 | A1 | 7/2009 | Mijares et al. |
| 2009/0183529 | A1 | 7/2009 | Modiano |
| 2009/0320177 | A1 | 12/2009 | Lin et al. |
| 2010/0031966 | A1 | 2/2010 | Allen |
| 2010/0064408 | A1 | 3/2010 | Kemper |
| 2010/0138975 | A1 | 6/2010 | Jordan et al. |
| 2010/0212063 | A1 | 8/2010 | Baucom et al. |
| 2010/0299805 | A1 | 12/2010 | Graneto, III |
| 2010/0300459 | A1 | 12/2010 | Lair |
| 2010/0313323 | A1 | 12/2010 | Tennelle |
| 2011/0023210 | A1 | 2/2011 | Porowski |
| 2011/0024485 | A1 | 2/2011 | Porowski |
| 2011/0154554 | A1 | 6/2011 | Furlong |
| 2011/0167534 | A1 | 7/2011 | Wong et al. |
| 2011/0231981 | A1 | 9/2011 | Appel et al. |
| 2011/0315150 | A1 | 12/2011 | Bream, Jr. |
| 2012/0047623 | A1 | 3/2012 | van Oudenallen et al. |
| 2012/0054940 | A1 | 3/2012 | Halseth |
| 2012/0060257 | A1 | 3/2012 | Herzog |
| 2012/0124722 | A1 | 5/2012 | Yadav et al. |
| 2012/0305541 | A1 | 12/2012 | Giles |
| 2012/0312308 | A1 | 12/2012 | Allen |
| 2013/0091615 | A1 | 4/2013 | Pasko et al. |
| 2013/0091616 | A1 | 4/2013 | Muche et al. |
| 2013/0191960 | A1 | 8/2013 | Pasko |
| 2013/0198930 | A1 | 8/2013 | Levine |
| 2013/0239290 | A1 | 9/2013 | Rossi |
| 2013/0276204 | A1 | 10/2013 | Pasko et al. |
| 2013/0318682 | A1 | 12/2013 | Graneto, III |
| 2014/0007316 | A1 | 1/2014 | Tommarello et al. |
| 2014/0082816 | A1 | 3/2014 | Christopher |
| 2014/0173814 | A1 | 6/2014 | Yadav et al. |
| 2014/0182043 | A1 | 7/2014 | Moore |
| 2014/0189931 | A1 | 7/2014 | Fredrickson |
| 2014/0215681 | A1 | 8/2014 | Goodman |
| 2015/0089712 | A1 | 4/2015 | Gamble |
| 2015/0096099 | A1 | 4/2015 | Vanneste |
| 2015/0113698 | A1 | 4/2015 | Gregerson-Brown |
| 2015/0135397 | A1 | 5/2015 | Levine |
| 2015/0135398 | A1 | 5/2015 | Czajka et al. |
| 2015/0208741 | A1 | 7/2015 | Pasko |
| 2015/0213215 | A1 | 7/2015 | Kobayashi et al. |
| 2018/0343940 | A1* | 12/2018 | Genender ..... A41D 13/1236 |

FOREIGN PATENT DOCUMENTS

| | | |
|---|---|---|
| CN | 302083878 | 9/2012 |
| DE | 8904426 | 5/1989 |
| DE | 202006005966 | 10/2006 |
| DE | 102009024999 | 12/2010 |
| DE | 102011016497 | 10/2012 |
| EM | 001320857 | 3/2012 |
| EP | 143204 | 6/1985 |
| EP | 0335041 | 10/1989 |
| EP | 335041 | 10/1989 |
| EP | 1362520 | 11/2003 |
| EP | 1407324-0001 | 5/2014 |
| EP | 1407324-0002 | 5/2014 |
| EP | 1407324-0003 | 5/2014 |
| EP | 1407324-0004 | 5/2014 |
| FR | 2709643 | 3/1995 |
| KR | 101116311 | 3/2012 |
| WO | 99/04721 | 2/1999 |
| WO | 2007/083032 | 7/2007 |
| WO | 2008/146138 | 12/2008 |
| WO | 2008146138 | 12/2008 |
| WO | 2014159401 | 10/2014 |

OTHER PUBLICATIONS

Haden, Sally , "Appeal Decision", U.S. Appl. No. 14/924,755; Filed Nov. 15, 2015; dated Mar. 24, 2020.

Haden, Sally , "Notice of Allowance", U.S. Appl. No. 13/276,232; Filed Oct. 18, 2011; dated Sep. 3, 2019.

Haden, Sally , "Notice of Allowance", U.S. Appl. No. 13/925,532; Filed Jun. 24, 2013; dated Sep. 3, 2019,.

Haden, Sally Cline , "Appeal Decision", U.S. Appl. No. 13/925,617; Filed Jun. 24, 2013; dated Oct. 17, 2019.

Haden, Sally Cline , "Notice of Allowance", U.S. Appl. No. 14/679,628; Filed Apr. 6, 2015; dated Sep. 17, 2019.

Nguyen, Camtu T. , "Non-Final Office Action", U.S. Appl. No. 15/718,994, filed Sep. 28, 2017; dated Mar. 17, 2020.

Walshon, Rashida , "Notice of Allowance", U.S. Appl. No. 29/591,354; Filed Jan. 19, 2017; dated Oct. 8, 2019.

3M Product Clinical Data Summary for No. 1521, 3M Plastic Medical Tape, Jan. 1996 (2 pages).

3M Technical Information Sheet, Product No. 1521, Feb. 2007 (2 pages).

Blue Medical Gown; Manufactured by Medline Industries, Inc.; Unknown availability date but believed to be prior to 1999.

Country Living down under. <URL: http://countrylivingdownunder.yuku.com/topic/6395/How-to-attach-elastic-to-gather-andto-shit#.WQCbi_krJaQ.> Jun. 2, 2014. Gathering with elastic.

Definition of Progressive. Merriam-Webster. Merriam-Webster, n.d. Web. May 17, 2016.

Description and Photographs of 75-1040 Fenestrated Snap Drape (as of Oct. 6, 2008) (1 page).

Description and Photographs of a Perforated Drape With Tear Line (as of Oct. 6, 2008) (1 page).

Description and Photographs of D-09875-001 Snap Drape (as of Oct. 6, 2008) (1 page).

Description and Photographs of Perforated Drapes (as of Oct. 6, 2008) (2 pages).

Disposable Medical Gown; Elastic Cuffs; Salamint, posted at salaaming.com, posting date n/a, copyright 2015 salamin.com, online, site visit Mar. 11, 2016; Available from https://www.salamint.com/productdetail.aspx?id=358.

Disposable Medical Gown; Thumb Loop Plastic Disposable Medical Surgical Gown, posting date n/a, copyright 1999-2016 alibaba.com; site visited Mar. 11, 2016, available from http://www.alibaba.com/product-detail/CPE-Gown-Thumb-loop-White-color_60043196775.html.

European Search Report for European Application No. 09167307.9 dated Oct. 11, 2010 (5 pages).

Fashion Flats, <URLL http:fashion-flats.com/images/1_details_set_in_sleeves.jpr> Visited by Examiner May 21, 2015; Types of set-in sleeves.

Go Japan Go. <URL http://www.gojapangp.com/fashion/hadajuban_kimono.html>. Visited Feb. 4, 2016. Hadajuban.

Jendela Sastra. <URL: http://www.jendelasatra.com/karya/puisi/hadajuban-dalam-kimono>. Poem with picture published Jan. 10, 2014. Hadajuban (first layer of kimono).

Lyst. <URL: https://ww.lyst.com/clothing/chritophe-lemaire-yak-hair-wool-thumbhole-sweater-moss-stone/.> Visited Apr. 26, 2017 by Examiner of U.S. Appl. No. 29/545,806; Chritophe Lemaire Thumbhole Sweater.

Medical Single Coated Film Tapes Selection Guide—Polyolefin & Vinyl, Nov. 1996 (3 pages).

Rakuten. <URL: http://global.rakuten.com/en/store/753ya/item/100131328/[2/4/2016%201:51:48%20PM]>. Visited Feb. 4, 2016. Hada-Juban.

Sakura-San. <URL: http://www.sakura-san.de/Juban.htm> Saved Jul. 12, 2013. Juban Furisode and Hada-Juban layers for kimono.

The visual dictionary. <RURL: http://www.infovisual.info/06/049_en.html> Jun. 1, 2013. types of cuffs.

The visual dictionary. <URL: http://www.infovisual.info/06/049_en.html>. types of cuffs (Examiner provided updated NPL (viewed Apr. 24, 2019) May 16, 2019 from original views Examiner provided in U.S. Appl. No. 29/467,612 filed Jun. 5, 2015).

(56) References Cited

OTHER PUBLICATIONS

Vintage Patterns Wikia. <URL: https//vintagepatterns.wikia.com/wiki/Butterikc_5374.> visited Dec. 9, 2015. Butterick 5374—Vintage Sewing Blouse Pattern.
"Appeal Decision", U.S. Appl. No. 13/276,232, filed Oct. 18, 2011; mailed May 31, 2016.
"BurdaStyle Women's Size Chart", http://www.burdastyle.com/downloads/SizeChart_Regular_inches.pdf; Publication Date Unknown.
"Final OA", U.S. Appl. No. 14/086,798, filed Nov. 21, 2013; dated Feb. 1, 2016.
"Medline Catalog", 2-Ply Sterile Cotton Stockinette by Alba-Waldensian; Medline Catalog; http://www.medline.com/catalog/catalog.jsp; Unknown Publication date but believed to be prior to present application filing date.
"Medline Catalog", Cotton Stockinette by Alba-Waldensian; Medline Catalog; http://www.medline.com/catalog/catalog.jsp; Unknown Publication date but believed to be prior to present application filing date.
"Medline Catalog", Full BodyDrapes by Halyard Health; Medline Catalog; http://www.medline.com/catalog/catalog.jsp; Unknown Publication date but believed to be prior to present application filing date.
"Medline Catalog", K-C100 Mayo Stand Covers by Halyard Health; Medline Catalog; http://www.medline.com/catalog/catalog.jsp; Unknown Publication date but believed to be prior to present application filing date.
"Medline Catalog", Midline Cath Picc Kits by Medikmark; Medline Catalog; http://www.medline.com/catalog/catalog.jsp; Unknown Publication date but believed to be prior to present application filing date.
"Medline Catalog", PICC Full Body Coverage Pack by Halyard Health; Medline Catalog; http://www.medline.com/catalog/catalog.jsp; Unknown Publication date but believed to be prior to present application filing date.
"Medline Catalog", Single Ply Standard Stockinettes by DeRoyal; Medline Catalog; http://www.medline.com/catalog/catalog.jsp; Unknown Publication date but believed to be prior to present application filing date.
"Medline Catalog", Single-Ply Sterile Stockinettes by Kerma Medical; Medline Catalog; http://www.medline.com/catalog/catalog.jsp; Unknown Publication date but believed to be prior to present application filing date.
"Medline Catalog", Sterile Bias Cute Cuttron Stockinette by Alba-Waldensian; Medline Catalog; http://www.medline.com/catalog/catalog.jsp; Unknown Publication date but believed to be prior to present application filing date.
"Medline Catalog", Stockinette by Derma Sciences; Medline Catalog; http://www.medline.com/catalog/catalog.jsp; Unknown Publication date but believed to be prior to present application filing date.
"Medline Catalog", Strl Stockinette Cttn 1-Ply by Alba-Waldensian; Medline Catalog; http://www.medline.com/catalog/catalog.jsp; Unknown Publication date but believed to be prior to present application filing date.
"Medline Catalog", TG Stockinettes by Lohmann and Rauscher; Medline Catalog; http://www.medline.com/catalog/catalog.jsp; Unknown Publication date but believed to be prior to present application filing date.
"Medline Catalog", Tube, Luki 864304; Medline Catalog; http://www.medline.com/catalog/catalog.jsp; Unknown Publication date but believed to be prior to present application filing date.
"Office Action", Canadian Office Action for Canadian Patent No. 2,674,951 dated May 4, 2011 (3 pages).
"Publication", Fashion Flats by Garment Element; By Art Design Projects Inc.; www.fashioncroquis.com; visited May 21, 2015; types of raglan sleeves.
Bravo, Jocelyn , "NonFinal OA", U.S. Appl. No. 14/086,798, filed Nov. 21, 2013; dated May 20, 2019.
Byun, Sung C. , "PCT Search Report", PCT No. PCT/US2012/052079; Filed Aug. 23, 2012; dated Dec. 26, 2012.
Chang, Bong Ho , "PCT Search Report and Written Opinion", PCT/US2012/054659; Filed Sep. 11, 2012; dated Feb. 26, 2013.
Cline, Sally , "Restriction Req", U.S. Appl. No. 13/804,565, filed Mar. 14, 2013; Mailed Aug. 13, 2015.
Fitts, Carissa , "Final OA", U.S. Appl. No. 29/404,295, filed Oct. 18, 2011; dated Feb. 19, 2015.
Fitts, Carissa , "Final OA", U.S. Appl. No. 29/404,296, filed Oct. 18, 2011; dated Jul. 2, 2015.
Fitts, Carissa , "Final OA", U.S. Appl. No. 29/467,622, filed Sep. 20, 2013; dated Jul. 12, 2016.
Fitts, Carissa , "Final OA", U.S. Appl. No. 29/536,646, filed Aug. 18, 2015; dated Oct. 4, 2017.
Fitts, Carissa , "NonFinal OA", U.S. Appl. No. 29/404,295, filed Oct. 18, 2011; dated Jul. 1, 2014.
Fitts, Carissa , "NonFinal OA", U.S. Appl. No. 29/404,296, filed Oct. 18, 2011; dated Apr. 22, 2016.
Fitts, Carissa , "NonFinal OA", U.S. Appl. No. 29/404,296, filed Oct. 8, 2011; dated Oct. 9, 2014.
Fitts, Carissa , "NonFinal OA", U.S. Appl. No. 29/467,622, filed Sep. 20, 2013; dated Dec. 30, 2015.
Fitts, Carissa , "NonFinal OA", U.S. Appl. No. 29/467,622, filed Sep. 20, 2013; dated May 2, 2017.
Fitts, Carissa , "NonFinal OA", U.S. Appl. No. 29/467,623, filed Sep. 20, 2013; dated Jan. 13, 2016.
Fitts, Carissa , "NonFinal OA", U.S. Appl. No. 29/536,646, filed Aug. 18, 2015; dated Jun. 27, 2017.
Fitts, Carissa , "Notice of Allowance", U.S. Appl. No. 29/404,296, filed Oct. 18, 2011; dated Oct. 7, 2016.
Fitts, Carissa , "Notice of Allowance", U.S. Appl. No. 29/467,622, filed Sep. 20, 2013; dated Sep. 26, 2017.
Fitts, Carissa , "Notice of Allowance", U.S. Appl. No. 29/536,646, filed Aug. 18, 2015; dated Jul. 3, 2018.
Fitts, Carissa C , "Notice of Allowance", U.S. Appl. No. 29/46/,623, filed Sep. 20, 2013; dated Jan. 13, 2017.
Haden, Sally , "Appeal Decision", U.S. Appl. No. 13/276,232, filed Oct. 18, 2011; dated Sep. 17, 2018.
Haden, Sally , "Appeal Decision", U.S. Appl. No. 13/804,565, filed Mar. 14, 2013; Mailed Jan. 8, 2019.
Haden, Sally , "Appeal Decision", U.S. Appl. No. 13/925,532, filed Jun. 24, 2013; Mailed Jan. 8, 2019.
Haden, Sally , "Appeal Decision", U.S. Appl. No. 13/925,598, filed Jun. 24, 2013; Mailed Sep. 7, 2018.
Haden, Sally , "Appeal Decision", U.S. Appl. No. 13/925,617, filed Jun. 24, 2013; Mailed June 6, 2017.
Haden, Sally , "Final OA", U.S. Appl. No. 13/925,598, filed Jun. 24, 2013; dated Sep. 6, 2016.
Haden, Sally , "Final OA", U.S. Appl. No. 13/925,617, filed Jun. 24, 2013; dated Oct. 25, 2018.
Haden, Sally , "NonFinal OA", U.S. Appl. No. 13/276,232, filed Oct. 18, 2011; dated Aug. 11, 2016.
Haden, Sally , "NonFinal OA", U.S. Appl. No. 13/925,532, filed Jun. 24, 2013; dated Jan. 8, 2016.
Haden, Sally , "NonFinal OA", U.S. Appl. No. 13/925,598, filed Jun. 24, 2013; dated Dec. 15, 2015.
Haden, Sally , "NonFinal Office Action", U.S. Appl. No. 13/925,617, filed Jun. 24, 2013; dated May 21, 2018.
Haden, Sally , "Notice of Allowance", U.S. Appl. No. 13/276,232, filed Oct. 18, 2011; dated Dec. 20, 2018.
Haden, Sally , "Notice of Allowance", U.S. Appl. No. 13/925,532, filed Jun. 24, 2013; dated Jan. 11, 2019.
Haden, Sally , "Notice of Allowance", U.S. Appl. No. 13/925,617, filed Jun. 24, 2013; dated Sep. 12, 2017.
Haden, Sally , "Notice of Allowance", U.S. Appl. No. 14/679,628, filed Apr. 6, 2015; dated Mar. 29, 2019.
Haden, Sally C. , "Final OA", U.S. Appl. No. 13/276,232, filed Oct. 18, 2011; dated Jul. 17, 2013.
Haden, Sally C. , "Final OA", U.S. Appl. No. 13/804,565, filed Mar. 14, 2013; dated May 19, 2016.
Haden, Sally C. , "Final OA", U.S. Appl. No. 13/804,565, filed Mar. 14, 2013; dated May 8, 2017.
Haden, Sally C. , "Final OA", U.S. Appl. No. 13/925,617, filed Jun. 24, 2007; dated Dec. 3, 2013.

(56) References Cited

OTHER PUBLICATIONS

Haden, Sally C. , "Final OA", U.S. Appl. No. 13/925,617, filed Jun. 24, 2013; dated Dec. 3, 2013.
Haden, Sally C. , "Final OA", U.S. Appl. No. 14/679,628, filed Apr. 6, 2015; dated Oct. 25, 2018.
Haden, Sally C. , "Final OA", U.S. Appl. No. 14/942,755, filed Nov. 16, 2015; dated Mar. 27, 2018.
Haden, Sally C. , "Final Office Action", U.S. Appl. No. 13/276,232, filed Oct. 18, 2011; dated Jan. 13, 2017.
Haden, Sally C. , "NonFinal OA", U.S. Appl. No. 13/276,232, filed Oct. 18, 2011; dated Apr. 8, 2013.
Haden, Sally C. , "NonFinal OA", U.S. Appl. No. 13/804,565, filed Mar. 14, 2013; dated Oct. 29, 2015.
Haden, Sally C. , "NonFinal OA", U.S. Appl. No. 13/925,617, filed Jun. 24, 2013; dated Aug. 13, 2014.
Haden, Sally C. , "NonFinal OA", U.S. Appl. No. 13/925,617, filed Jun. 24, 2013; dated Aug. 14, 2013.
Haden, Sally C. , "NonFinal OA", U.S. Appl. No. 14/679,628, filed Apr. 6, 2015; dated Sep. 5, 2017.
Haden, Sally C. , "Notice of Allowance", U.S. Appl. No. 13/804,565, filed Mar. 14, 2013; dated Mar. 28, 2019.
Haden, Sally Cline , "Final OA", U.S. Appl. No. 13/925,532, filed Jun. 24, 2013; dated Sep. 26, 2016.
Haden, Sally Cline , "NonFinal OA", U.S. Appl. No. 13/804,565, filed Mar. 14, 2013; dated Jan. 19, 2017.
Haden, Sally Cline , "NonFinal OA", U.S. Appl. No. 13/925,532, filed Jun. 24, 2013; dated Aug. 9, 2017.
Haden, Sally Cline , "NonFinal OA", U.S. Appl. No. 13/925,532, filed Jun. 24, 2013; dated May 23, 2016.
Haden, Sally Cline , "NonFinal OA", U.S. Appl. No. 13/925,598, filed Jun. 24, 2013; dated May 24, 2016.
Haden, Sally Cline , "NonFinal OA", U.S. Appl. No. 14/942,755, filed Nov. 16, 2015; dated Sep. 8, 2017.
Haines, Kimberly , "Notice of Allowance", U.S. Appl. No. 13/116,473, filed May 26, 2011; dated May 2, 2017.
Harris, Raymond E. , "NonFinal OA", U.S. Appl. No. 12/537,961, filed Aug. 17, 2009; dated Jul. 17, 2012.
Harris, Raymond E. , "Appeal Decision", U.S. Appl. No. 12/573,961, filed Aug. 7, 2009; Mailed Mar. 6, 2017.
Harris, Raymond E. , "Final OA", U.S. Appl. No. 12/537,961, filed Aug. 7, 2009; dated Nov. 21, 2012.
Harris, Raymond E. , "Final Office Action", U.S. Appl. No. 12/537,961, filed Aug. 7, 2009; dated Apr. 11, 2012.
Harris, Raymond E. , "Non-Final Office Action", U.S. Appl. No. 12/537,961, filed Aug. 7, 2009; dated Nov. 9 2011.
Harris, Raymond E. , "Notice of Allowance", U.S. Appl. No. 12/537,961, filed Aug. 7, 2009; dated Oct. 6, 2017.
Hicks, Victoria , "Final OA", U.S. Appl. No. 13/116,473, filed May 26, 2011; dated Nov. 22, 2013.
Hicks, Victoria , "Final OA", U.S. Appl. No. 13/229,743, filed Sep. 11, 2011; dated Aug. 7, 2014.
Hicks, Victoria , "Final OA", U.S. Appl. No. 13/589,640, Filed Aug. 20, 2012; dated Jan. 2, 2015.
Hicks, Victoria , "NonFinal OA", U.S. Appl. No. 13/116,473, filed May 26, 2011; dated May 16, 2013.
Hicks, Victoria , "NonFinal OA", U.S. Appl. No. 13/229,743, filed Sep. 11, 2011; dated Feb. 10, 2014.
Hicks, Victoria , "NonFinal OA", U.S. Appl. No. 13/589,640, filed Aug. 20, 2012; dated Jun. 13, 2014.
Hicks, Victoria , "Notice of Allowance", U.S. Appl. No. 13/116,473, filed May 26, dated Aug. 15, 2017.
Hicks, Victoria , "Notice of Allowance", U.S. Appl. No. 13/229,743, filed Sep. 11, 2011; dated Jan. 2, 2018.
Hicks, Victoria , "Notice of Allowance", U.S. Appl. No. 13/589,640, filed Aug. 20, 2012; dated Dec. 19, 2017.
Lee, Cheol Soo , "International Search Report", PCT/US2012/032122; Filed Apr. 4, 2012; dated Nov. 1, 2012.
Lee, Jong Kyung , "PCT Search Report and Written Opinion", PCT/US2014/023432; Filed Mar. 11, 2014; dated Jul. 10, 2014.
Mcvey, Lauren , "Ex Parte Quayle", U.S. Appl. No. 29/467,603, filed Sep. 20, 2013; Mailed Jul. 26, 2017.
Mcvey, Lauren , "Final OA", U.S. Appl. No. 29/459,047, filed Jun. 25, 2013 dated Sep. 24, 2015.
Mcvey, Lauren , "Final OA", U.S. Appl. No. 29/467,616, filed Sep. 20, 2013; dated Nov. 3, 2015.
McVey, Lauren , "Final OA", U.S. Appl. No. 29/467,619, filed Sep. 20, 2013; dated Oct. 20, 2015.
McVey, Lauren , "Final OA", U.S. Appl. No. 29/467,621, filed Sep. 20, 2013; dated Apr. 11, 2016.
McVey, Lauren , "Final OA", U.S. Appl. No. 29/545,805, filed Nov. 16, 2015; dated May 17, 2018.
McVey, Lauren , "Final OA", U.S. Appl. No. 29/545,806, filed Nov. 16, 2015; dated May 17, 2018.
McVey, Lauren , "Final OA", U.S. Appl. No. 29/467,603, filed Sep. 20, 2013; dated Feb. 10, 2016.
McVey, Lauren , "Final Office Action", U.S. Appl. No. 29/467,603, filed Sep. 20, 2013; dated Feb. 8, 2017.
McVey, Lauren , "Final Office Action", U.S. Appl. No. 29/545,802, filed Nov. 16, 2015; dated May 17, 2018.
McVey, Lauren , "NonFinal OA", U.S. Appl. No. 29/459,047, filed Jun. 25, 2013 dated Apr. 23, 2015.
McVey, Lauren , "NonFinal OA", U.S. Appl. No. 20/545,806, filed Nov. 16, 2015; dated May 3, 2019.
McVey, Lauren , "NonFinal OA", U.S. Appl. No. 29/467,603, filed Sep. 30, 2015; dated Jun. 30, 2015.
McVey, Lauren , "NonFinal OA", U.S. Appl. No. 29/467,612, filed Sep. 20, 2013; dated Jun. 5, 2015.
McVey, Lauren , "NonFinal OA", U.S. Appl. No. 29/467,616, filed Sep. 20, 2013; dated Jun. 17, 2015.
McVey, Lauren , "NonFinal OA", U.S. Appl. No. 29/467,621, filed Sep. 20, 2013; dated Aug. 26, 2015.
McVey, Lauren , "NonFinal OA", U.S. Appl. No. 29/467,625, filed Sep. 20, 2013; dated Jul. 29, 2015.
McVey, Lauren , "NonFinal OA", U.S. Appl. No. 29/545,802, filed Nov. 16, 2015; dated Jun. 1, 2017.
McVey, Lauren , "NonFinal OA", U.S. Appl. No. 29/545,805, filed Nov. 16, 2015; dated Dec. 10, 2018.
McVey, Lauren , "NonFinal OA", U.S. Appl. No. 29/545,805, filed Nov. 16, 2015; dated Jun. 2, 2017.
McVey, Lauren , "NonFinal OA", U.S. Appl. No. 29/545,805, filed Nov. 16, 2015; dated May 16, 2019.
McVey, Lauren , "NonFinal OA", U.S. Appl. No. 29/545,806, filed Nov. 16, 2015; dated Jun. 1, 2017.
McVey, Lauren , "NonFinal OA", U.S. Appl. No. 29/545,806, filed Nov. 16, 2015; dated Feb. 12, 2019.
McVey, Lauren , "Notice of Allowance", U.S. Appl. No. 29/459,047, filed Jun. 25, 2013; dated Aug. 10, 2016.
McVey, Lauren , "Notice of Allowance", U.S. Appl. No. 29/459,047, filed Jun. 25, 2013; dated Oct. 19, 2016.
McVey, Lauren , "Notice of Allowance", U.S. Appl. No. 29/459,060, filed Jun. 25, 2013; dated Apr. 23, 2015.
McVey, Lauren , "Notice of Allowance", U.S. Appl. No. 29/467,616, filed Sep. 20, 2013; dated Aug. 10, 2016.
McVey, Lauren , "Notice of Allowance", U.S. Appl. No. 29/467,620, filed Sep. 20, 2013; dated Jun. 23, 2015.
McVey, Lauren , "Notice of Allowance", U.S. Appl. No. 29/467,621, filed Sep. 20, 2013; dated Oct. 20, 2016.
McVey, Lauren , "Notice of Allowance", U.S. Appl. No. 29/467,623, filed Sep. 20, 2013; dated Aug. 30, 2016.
McVey, Lauren , "Notice of Allowance", U.S. Appl. No. 29/545,802, filed Nov. 16, 2015; dated Feb. 19, 2019.
McVey, Lauren D. , "NonFinal OA", U.S. Appl. No. 29/467,619, filed Sep. 20, 2013; dated May 20, 2015.
Vanatta, Amy , "Non-Final Office Action", U.S. Appl. No. 12/720,360, filed Mar. 9, 2010; dated Oct. 11, 2011.
Vanatta, Amy B. , "Notice of Allowance", U.S. Appl. No. 12/720,360, filed Mar. 9, 2012; dated Feb. 9, 2012.
Walshon, Rashida , "Final OA", U.S. Appl. No. 29/506,290, filed Oct. 14, 2014; dated Jul. 28, 2016.
Walshon, Rashida , "Final Office Action", U.S. Appl. No. 29/591,354, filed Nov. 13, 2018.

(56) References Cited

OTHER PUBLICATIONS

Walshon, Rashida , "NonFinal OA", U.S. Appl. No. 29/506,290, filed Oct. 14, 2014; dated Jan. 20, 2016.
Walshon, Rashida , "NonFinal OA", U.S. Appl. No. 29/591,354, filed Jan. 19, 2017; dated Oct. 4, 2017.
Walshon, Rashida , "Non-FInal OA", U.S. Appl. No. 29/591,354, filed Jan. 19, 2017; dated Apr. 17, 2018.
Walshon, Rashida , "Notice of Allowance", U.S. Appl. No. 29/591,354, filed Jan. 19, 2017; dated Jun. 19, 2019.
Wright, Jennifer , "NonFinal OA", U.S. Appl. No. 29/506,294, filed Oct. 14, 2014; dated Mar. 28, 2016.
Wright, Jennifer , "NonFinal Oa", U.S. Appl. No. 29/506,294, filed Oct. 14, 2014; dated Sep. 23, 2016.
Wu, Jocelyn Mary , "NonFinal OA", U.S. Appl. No. 14/086,798, filed Nov. 21, 2013; dated Sep. 24, 2015.
McVey, Lauren , "Appeal Decision", U.S. Appl. No. 29/545,805, filed Nov. 16, 2015; dated Feb. 2, 2021.
McVey, Lauren , "Appeal Decision", U.S. Appl. No. 29/545,806, filed Nov. 16, 2015; Mailed Feb. 1, 2021.
Haden, Sally C. , "NonFinal Office Action", U.S. Appl. No. 13/925,617, filed Jun. 24, 2013; dated Sep. 28, 2020.

* cited by examiner

DISPOSABLE MEDICAL GOWN

CROSS REFERENCE TO PRIOR APPLICATIONS

This application is a continuation of, and thus claims priority and benefit under 35 USC § 120 to, U.S. application Ser. No. 14/942,755, filed Nov. 16, 2015, which is a continuation of, and thus claims priority and benefit under 35 USC § 120 to, U.S. application Ser. No. 13/804,565, filed Mar. 14, 2013, which is a continuation-in-part of, and thus claims priority and benefit under 35 USC § 120 to, U.S. application Ser. No. 13/276,232, filed Oct. 18, 2011, each of which is incorporated by reference for all purposes.

BACKGROUND

Technical Field

This invention relates generally to medical gowns, and more particularly to disposable medical gowns.

Background Art

Medical gowns are commonly used in hospitals, clinics and other diagnostic facilities. Medical gowns are worn by both patients and health care providers during medical procedures. Medical gowns serve a protective function by helping to prevent the transmission of germs and microbes. Additionally, gowns worn by the patient provide a privacy function and help to preserve patient dignity by covering the patient's body prior to examination or prior to a medical procedure. For instance, a particular medical examination may require the patient to disrobe. Donning a medical gown serves as a "cover-up" in that it covers the patient's unclad body until the examination or procedure can be performed.

One issue with prior art medical gowns is that they are time-consuming to put on and take off. It would be advantageous to have an improved medical gown that is quicker and simpler to don and remove.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
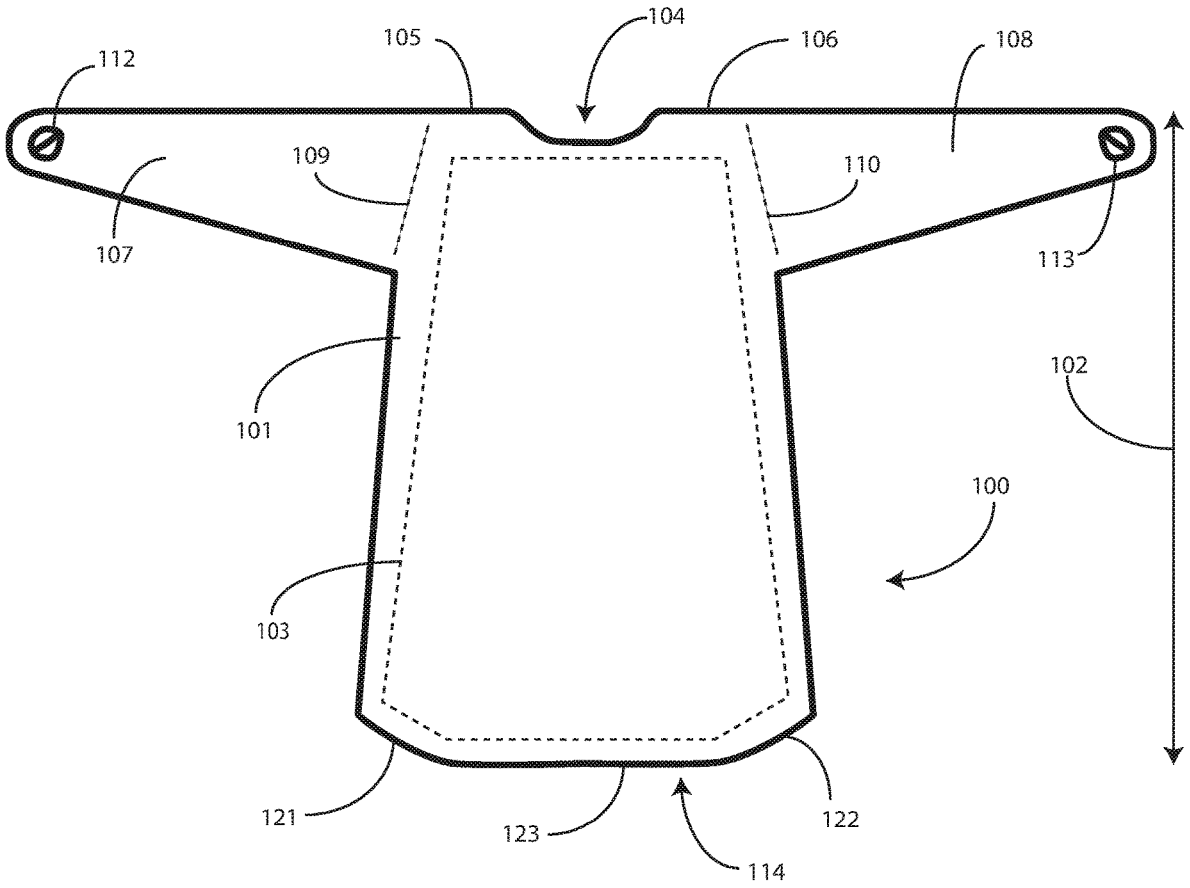
FIG. 1 illustrates a front view of one example of a gown configured in accordance with one or more embodiments of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF EMBODIMENTS OF THE INVENTION

Embodiments of the invention are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. Also, reference designators shown herein in parenthesis indicate components shown in a figure other than the one in discussion. For example, talking about a device (10) while discussing figure A would refer to an element, 10, shown in figure other than figure A.

Embodiments of the present invention provide a disposable medical gown capable of being quickly donned by a patient or medical services provider, and are even more quickly removed. In one embodiment, for example, the gown is made from a non-woven material and includes one or more perforations, thereby enabling a user to easily tear the gown at the perforations or other locations when removing the gown.

Figure 2:
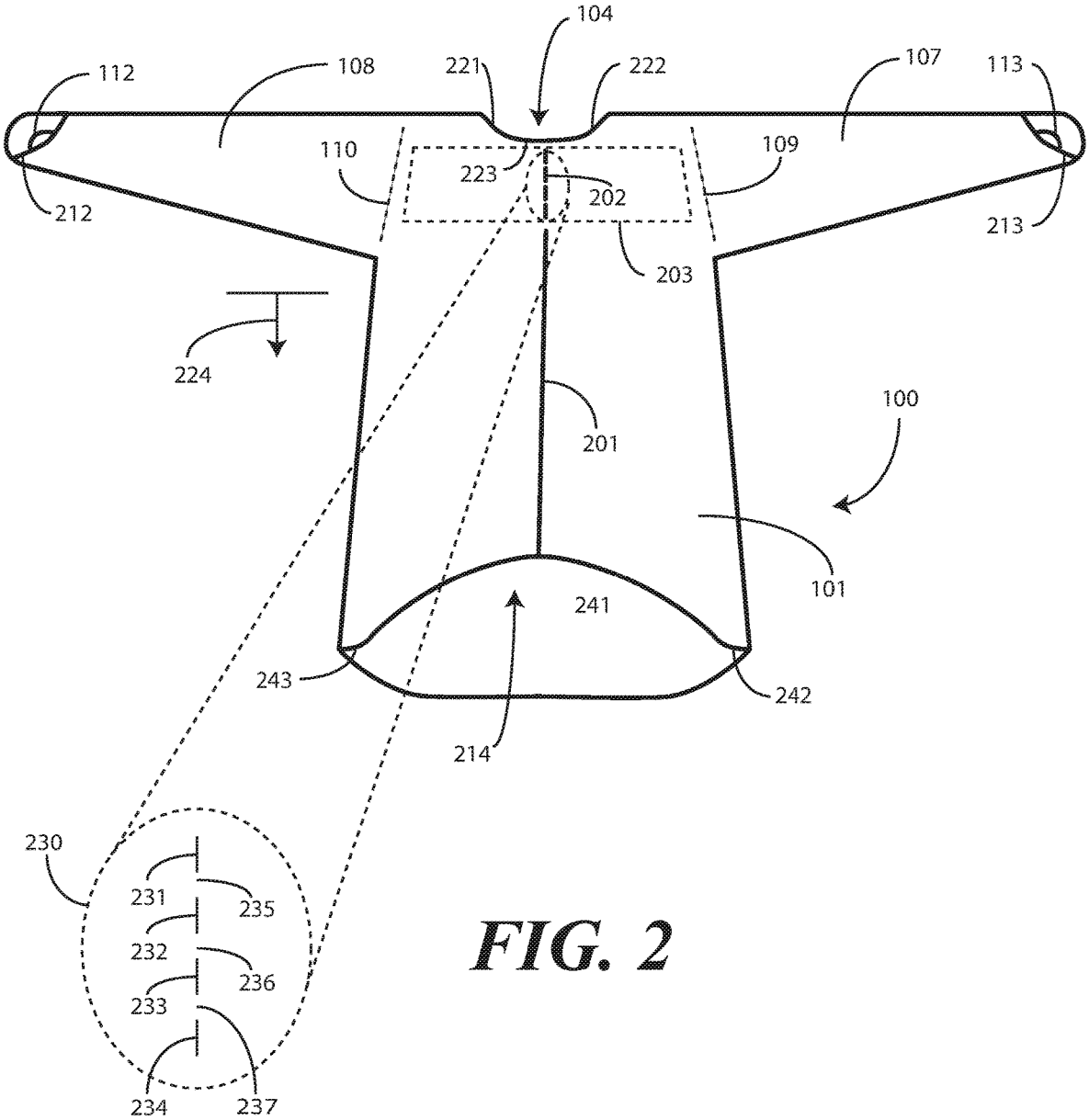
FIG. 2 illustrates a rear view of one example of a gown configured in accordance with one or more embodiments of the invention.

Turning now to FIGS. 1 and 2, illustrated therein is one example of a medical gown 100 configured in accordance with one or more embodiments of the invention. A body covering portion 101 is configured to wrap about the torso of a wearer. The body covering portion 101, in one embodiment, is manufactured from a single, unitary layer of non-woven fabric. The non-woven fabric can be a disposable material, and optionally can include and water resistant lining that prevents the passage of fluids through the body covering portion 101. In one embodiment, the length 102 of the medical gown 100 is configured to run from a wearer's shoulder to below their knee. In one embodiment, the gown 100 may optionally include pockets or other surface features. The gown 100 may be manufactured in various colors. However, experimental testing has shown that yellow is a color particularly well suited for medical procedures due to its high visibility and easy differentiation from a patient's skin.

The body covering portion 101 includes a front portion 103 and a rear portion 203. The front portion 103 is configured as a frontal body covering portion in that it is configured to cover the frontal portion of some or all of a user's body, or in another embodiment the frontal portion of some or all of a user's torso, when the user is wearing the gown. The body covering portion 101 further includes a rear portion 203 that is configured to cover at least a portion of a wearer's shoulder blades. In the illustrative example of FIGS. 1 and 2, the rear portion 203 has a substantially similar length with the front portion 103, although this will not be the case with all embodiments described below. In one embodiment for example, the front portion 103 will be longer than the rear portion 203, thereby covering more of the wearer's body in the front than the rear. In another embodiment, the front portion 103 will be shorter than the rear portion 203, thereby covering less of the wearer's body in the front than in the rear.

In one embodiment, the body covering portion 101 defines a head insertion aperture 104 through which a user may insert their head when donning the gown. In the illustrative embodiment of FIGS. 1 and 2, the head insertion aperture 104 is disposed between the front portion 103 and the rear portion 203, and is surrounded by shoulder portions 105,106 of the body covering portion 101. The perimeter of the head insertion aperture 104 can take a variety of shapes. For example, in the illustrative embodiment of FIGS. 1 and 2, the head insertion aperture 104 has an angle-tapered flat contour, with two angular side edges 221,222 radially interfacing with a substantially flat contour 223. Other embodiments described below may include different heat insertion aperture contours.

In one embodiment, the body covering portion 101 defines an opening 201. The front portion 103 of the gown 100 is configured, in one embodiment, to be placed against the front of the torso of a wearer. The body covering portion 101 then wraps around and terminates at the opening 201. The opening 201 in this embodiment has a left side and a right side, and is configured as a slit that runs most of the length 102 of the body covering portion 101, up the back of the medical gown 100.

The opening can be used to assist in donning the gown. For instance, a user may open the opening 201 and pass their head, shoulders, and/or torso portions through the opening 201 when donning the gown. Said differently, the right side and left side of the opening 201 can be configured to permit the wearer to don the gown 100 by wrapping the right side and left side 107 about the wearer's torso. In the illustrative embodiment of FIGS. 1 and 2, the opening 201 is disposed on a side 224 of the rear portion 203 opposite the head insertion aperture 104. The opening 201 then extends distally from the rear portion 203 to a base of the body covering portion 101.

In one embodiment, the gown 100 includes one or more perforations 202. In FIGS. 1 and 2, a single perforation 202 extends across the rear portion 203, at least partially between the opening 201 and the head insertion aperture 104. The perforation 202 can assist the user in removing the gown 100 by providing a score line that can be easily torn. Said differently, in one embodiment the perforation 202 is configured to tear when the front portion 103 is pulled away from the wearer. This will be shown in more detail in subsequent figures. When this occurs, the tearing of the perforation 202 results in a splitting of the rear portion 203. The splitting or tearing can cause the body covering portion 101 to separate between the head insertion aperture 104 and the opening 201, thus extending the opening 201 all the way to the head insertion aperture 104. A user can therefore easily remove the gown 100 by simply tearing the perforation 202 and pulling the gown 100 off In one embodiment, the perforation 202 comprises a plurality of scores 231,232,233,234, as shown in the magnified perforation view 230. Each of the scores 231,232, 233,234 is separated by a corresponding length 235,236,237 of material. While the configuration of the perforations 202 can take a variety of configurations, experimental testing has shown that some configurations are more suited to easy removal of the gown 100 than others. Additionally, some configurations are easier to manufacture than are others. One such example of a perforation 202 is where the plurality of scores 231,232,233,234 are each about one inch long. (The term "about is used to describe a quantity inclusive of manufacturing and other tolerances. For example, in a score designed to be one inch in length, manufacturing and other tolerances may result in the score being, for example, 1.02" or 0.972", each if which is "about" one inch as the term is used herein.) In one exemplary embodiment, the lengths 235,236,237 of material are each about one half inch long. In one exemplary embodiment, four scores are used to make the perforation 202.

Another example is a perforation 202 in which the plurality of scores, e.g., scores 231,232,233,234 et al., are each about three-quarters of an inch long. In this embodiment, the lengths of material, e.g., lengths 235,236,237 et al., are each about one quarter inch long. In one exemplary embodiment, nine scores are used to make perforation 202. While these illustrations provide a few examples of how the scores can be configured, others will be obvious to those of ordinary skill in the art having the benefit of this disclosure. For example, the progressive scores (3802) described below with reference to FIG. 38 could be used in place of the perforation (202) shown in FIG. 2.

In one embodiment, to further assist the user in removing the gown, the non-woven fabric is configured so as to be tearable by a wearer. For example, to non-woven fabric may have a tensile strength of between four and ten pounds. Thus, if a user were to grasp opposing sides of a section of the non-woven fabric, and then pull with a force of between four and ten pounds, the fabric would tear. As will be shown below, and one embodiment all where removes the gown by tearing the non-woven fabric. Accordingly, a non-woven fabric that is easily tearable by a wide range of wearers, e.g., male and female wearers, may be selected for construction of the medical gown 100 in accordance with such an embodiment.

In one embodiment, a first sleeve 107 and a second sleeve 108 extend distally from the body covering portion 101. The first sleeve 107 and the second sleeve 108 are configured to receive wearer's arms when the medical down 100 is donned. In one embodiment, each of the first sleeve 107 and the second sleeve 108 are configured as single, unitary pieces of non-woven fabric that are attached with the body covering portion 101 at a seams 109,110. The seams 109,110 can be sewn, although other attachment processes can be used as well. Examples of alternative attachment processes include adhesive bonding, mechanical or press-fit bonding, thermal bonding, and so forth. In the illustrated embodiment of FIGS. 1 and 2, the first sleeve 107 and second sleeve 108 are illustrated as long sleeves. However, it will be clear to those of ordinary skill in the art having the benefit of disclosure that embodiments of the invention are not so limited. Medical gowns in accordance with embodiments of the invention may equally be configured with short sleeves or no sleeves has a particular application may warrant.

In one or more embodiments, the sleeves 107,108 each terminate in a thumb loop. In one embodiment, the thumb loop comprises a thumb insertion aperture 112,113, through which a wearer's thumb may be inserted. In one embodiment, the thumb loop further comprises a hand saddle curvature termination 212,213. In this embodiment, the hand saddle curvature terminations 212,213 back the thumb insertion apertures and can be seen therethrough when the sleeves 107,108 are pressed flat. The backing of the thumb insertion apertures 112,113 by hand saddle curvature terminations 212,213 that work to permit the heel of a wearer's hand to be exposed when the thumb is inserted into the thumb insertion aperture 112,113. The thumb loops, where included, provide several functions. One illustrative function is that they keep the sleeves 107,108 pulled along the wearer's arms and prevent the sleeves 107,108 from "riding up." Another illustrative function is that the thumb loops prevent twisting of the sleeves 107,108 about the wearer's arm. Each thumb loop is configured, in one embodiment, to engage the saddle of a thumb of the wearer.

The bottom of the gown 100 can take a variety of shapes. For example, in the illustrative embodiment of FIGS. 1 and 2, the front base member 114 of the gown 100 substantially mirrors the shape of the perimeter of the head insertion aperture 104. In this case, the front base member 114 has an angle-tapered flat contour, with two angular side edges 121,122 radially interfacing with a substantially flat contour 123. Other embodiments described below may include different front contours. In this illustrative embodiment, the rear contour 214 takes a concave down contour, with an arched contour 241 spanning between two convex lobes 242,243.

Figure 3:
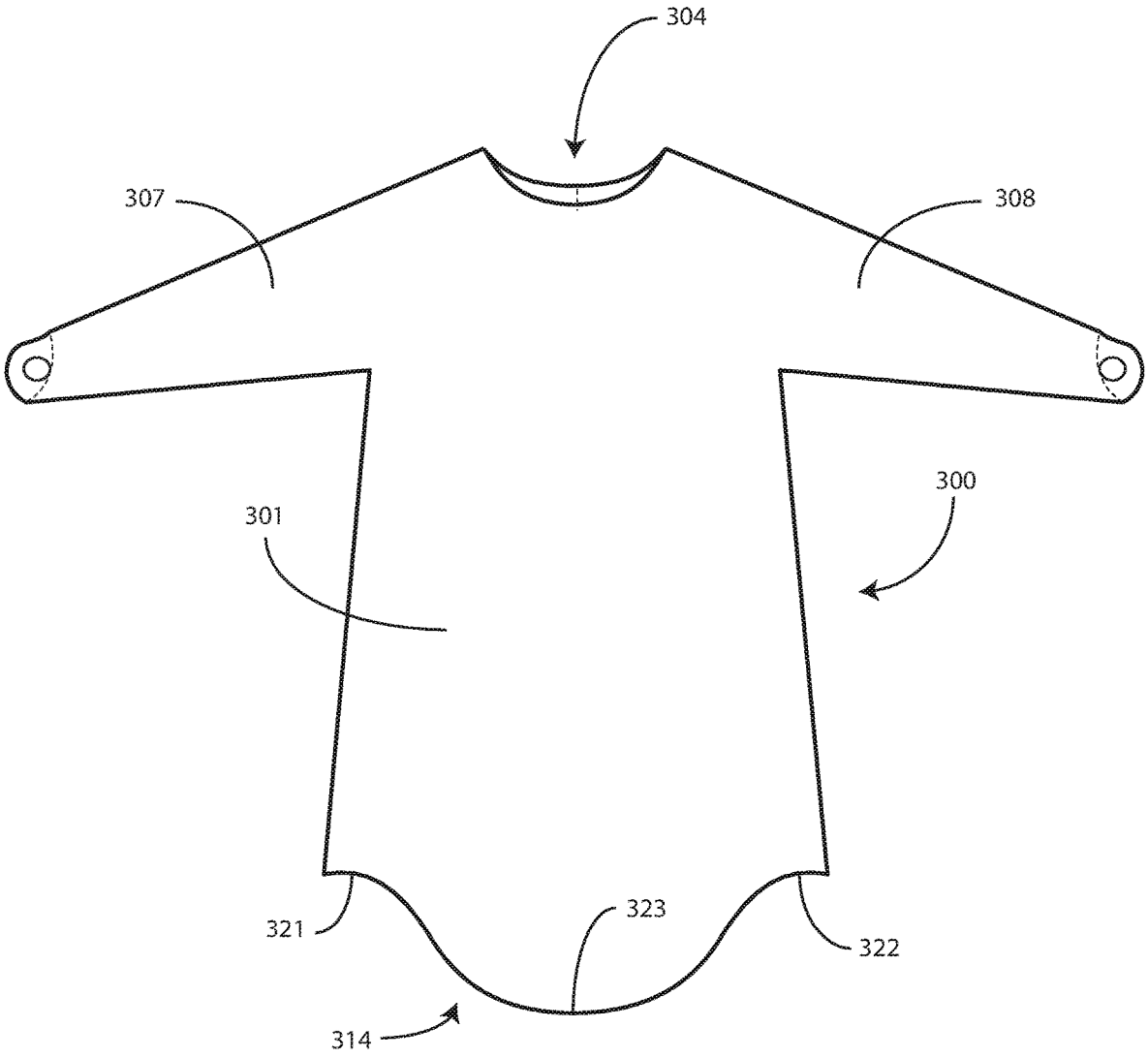
FIG. 3 illustrates a front view of another example of a gown configured in accordance with one or more embodiments of the invention.
Figure 4:
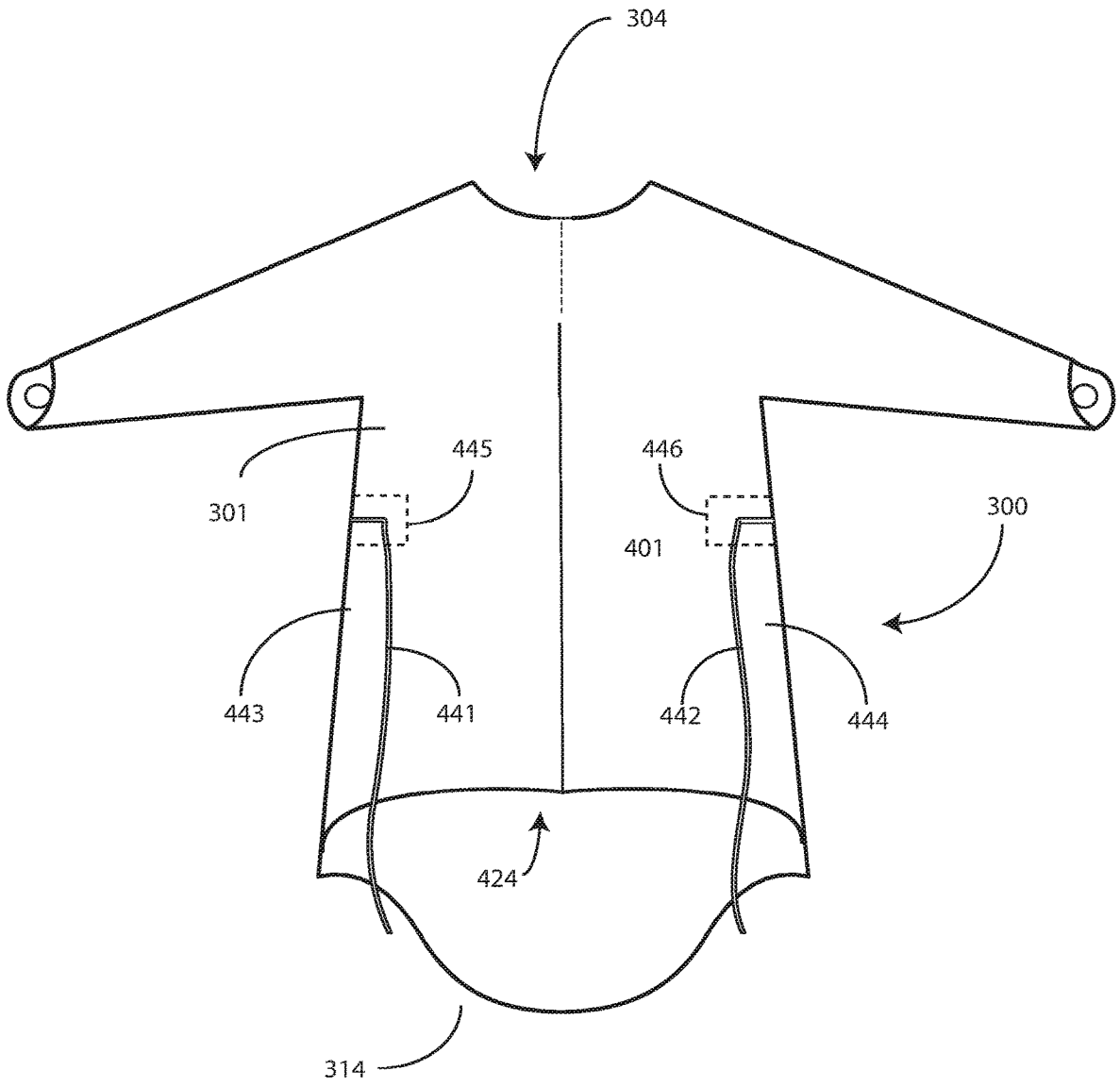
FIG. 4 illustrates a rear view of another example of a gown configured in accordance with one or more embodiments of the invention.
Figure 5:
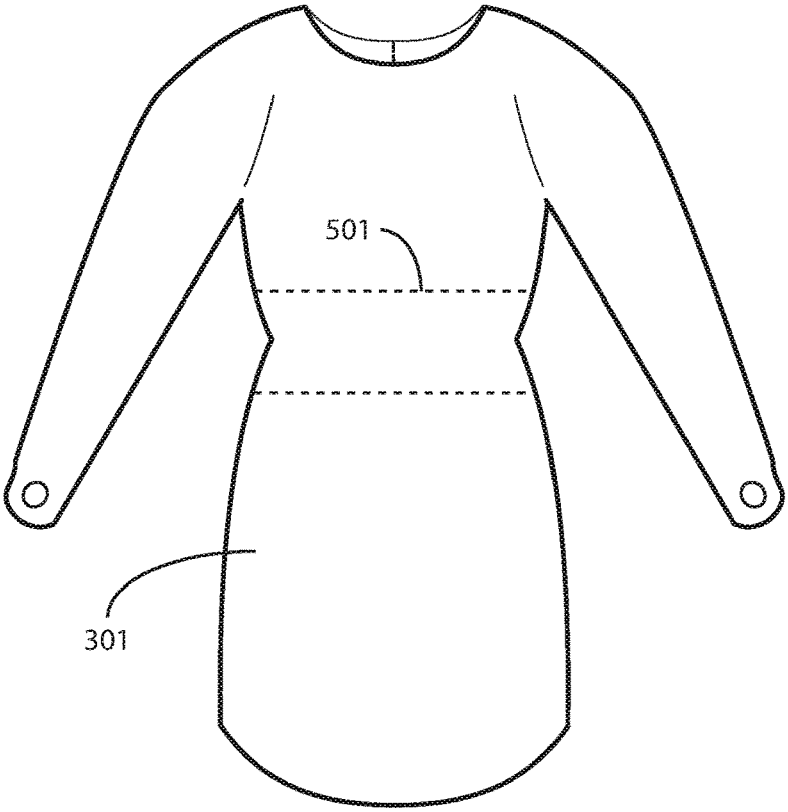
FIG. 5 illustrates a front view of another example of a gown configured in accordance with one or more embodiments of the invention having tie members tied.
Figure 6:
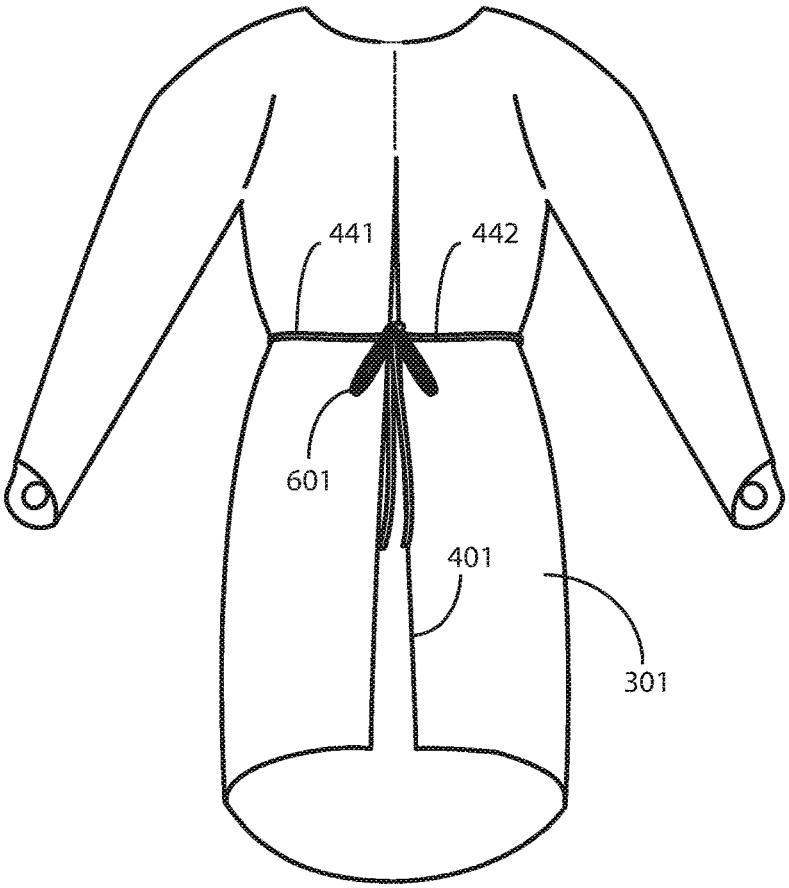
FIG. 6 illustrated a rear view of another example of a gown configured in accordance with one or more embodiments of the invention having tie members tied.
Figure 7:
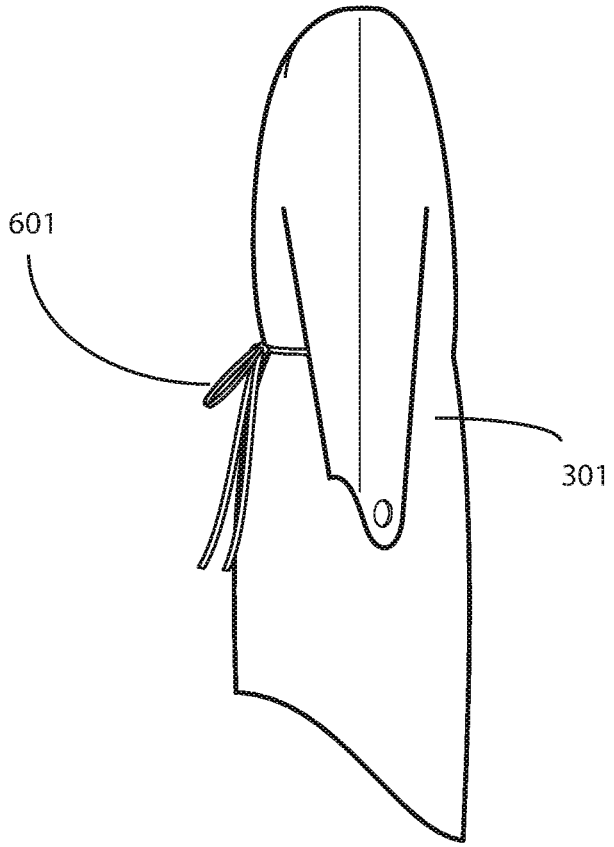
FIG. 7 illustrates a side view of another example of a gown configured in accordance with one or more embodiments of the invention having tie members tied.
Figure 8:
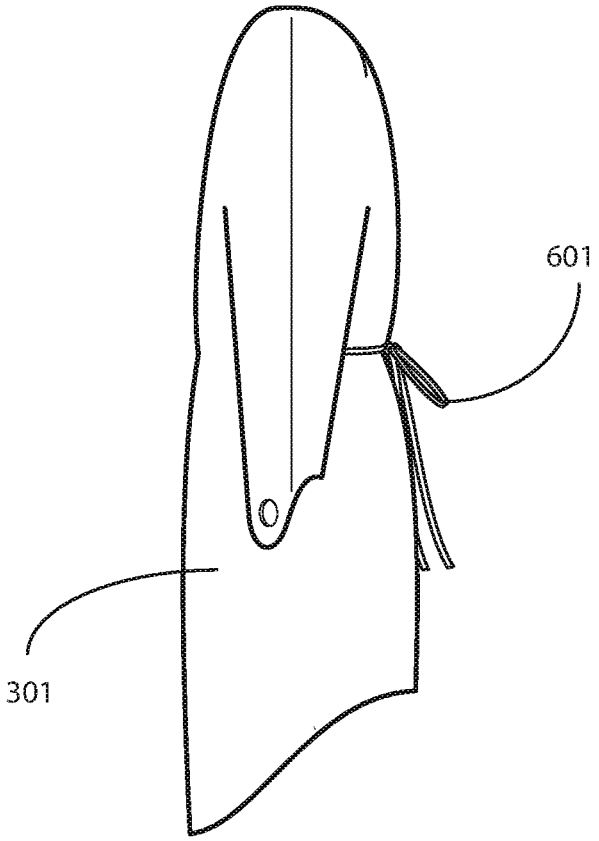
FIG. 8 illustrates another side view of another example of a gown configured in accordance with one or more embodiments of the invention having tie members tied.

Turning now to FIGS. 3 and 4, illustrated therein is another medical gown 300 configured in accordance with one or more embodiments of the invention. The elements that medical gown 300 shares with the gown (100) of FIGS. 1 and 2, including sleeves, body covering portion, front portion, rear portion, perforation, opening, and thumb loops, will not be repeated in the description of medical gown 300 for brevity.

The contour of the head insertion aperture 304 is different from that shown in FIGS. 1 and 2. In FIGS. 3 and 4, the head insertion aperture 304 is curved in a partially circular shape. Additionally, the front base member 114 is different from that shown in FIGS. 1 and 2. In the illustrative embodiment of FIGS. 3 and 4, the front base member 314 is concave-convex, with a major, central convex curvature 323 centrally spanning two minor concave curvatures 321,322. The concave-convex design permits a wearer to move their knees or legs vertically with the major, central convex curvature 323 providing privacy across the wearer's lower pelvic region.

Another difference is the rear base member 424. In this illustrative embodiment, the rear base member 424 is a simple concave down curvature, omitting the convex lobes (242,243) found in FIG. 2.

Another difference is with respect to the sleeves 307,308. While the sleeves (107,108) of FIGS. 1 and 2 were outstretched, with upwardly tapering base members, the sleeves 307,308 of FIGS. 3 and 4 are downwardly tapering, with downwardly tapering upper arm members.

One of the primary differences between the gown (300) of FIGS. 3 and 4 and the gown (100) of FIGS. 1 and 2 is the inclusion of one or more tie members 441,442 extending from the body covering portion 301. In this illustrative embodiment, the tie members include a first tie member 441 disposed on a first side 442 of the body covering portion 301, and a second tie member 442 disposed on a second side 444 of the body covering portion 301. Accordingly, one tie member 441 is disposed on one side of the opening 401, while the second tie member 442 is disposed on a second side of the opening 401.

The tie members 441,442 can be attached to the body covering portion 301 in a variety of ways. In one embodiment, the tie members 441,442 are sewn to the body covering portion 301. In another embodiment, the tie members 441,442 are adhesively attached to the body covering portion 301. In another embodiment, the tie members 441, 442 are thermally bonded to the body covering portion 301. Other attachment methods will be obvious to those of ordinary skill in the art.

In the illustrative embodiment of FIGS. 3 and 4, the tie members 441,442 are attached at hip regions 445,446 of the gown 300. Turning to FIGS. 5-8, when the tie members 441,442 are tied 601 across the opening 401, the body covering portion 301 become "cinched" at the waist region 501 about the wearer.

Figure 9:
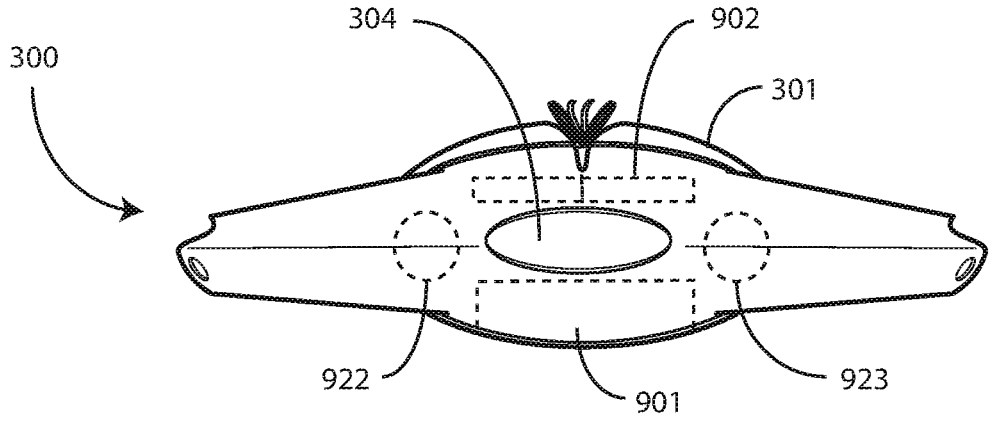
FIG. 9 illustrates a top view of another example of a gown configured in accordance with one or more embodiments of the invention having tie members tied.
Figure 10:
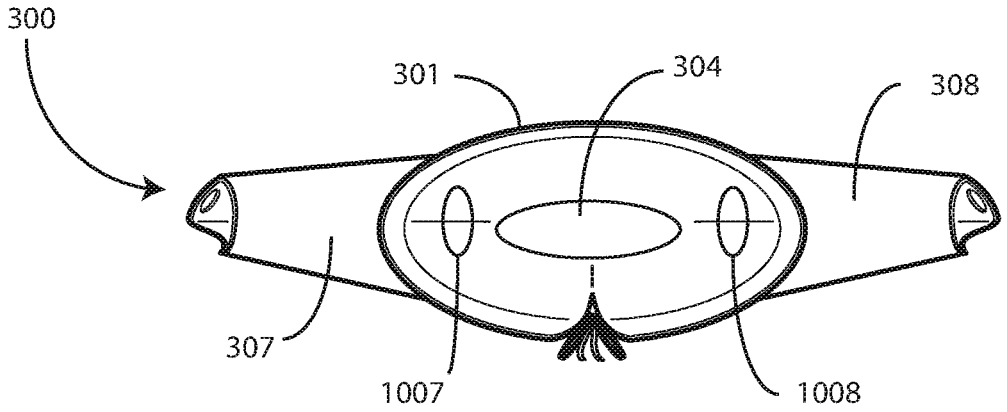
FIG. 10 illustrates a bottom view of another example of a gown configured in accordance with one or more embodiments of the invention having tie members tied.

Turning to FIGS. 9 and 10, additional features of the gown 300 can be seen. FIG. 9 provides a top plan view of the gown 300. From this view, it can be seen that the head insertion aperture 304 is disposed along the body covering portion 301 between the front portion 901 and rear portion 902. Also, the head insertion aperture 304 is disposed between shoulder portions 922,923. From the bottom plan view of FIG. 10, it can be seen that the sleeves 307,308, which extend distally away from the body covering portion 301, each defining an arm insertion aperture 1007,1008 at an interface with the body covering portion 301.

Figure 11:
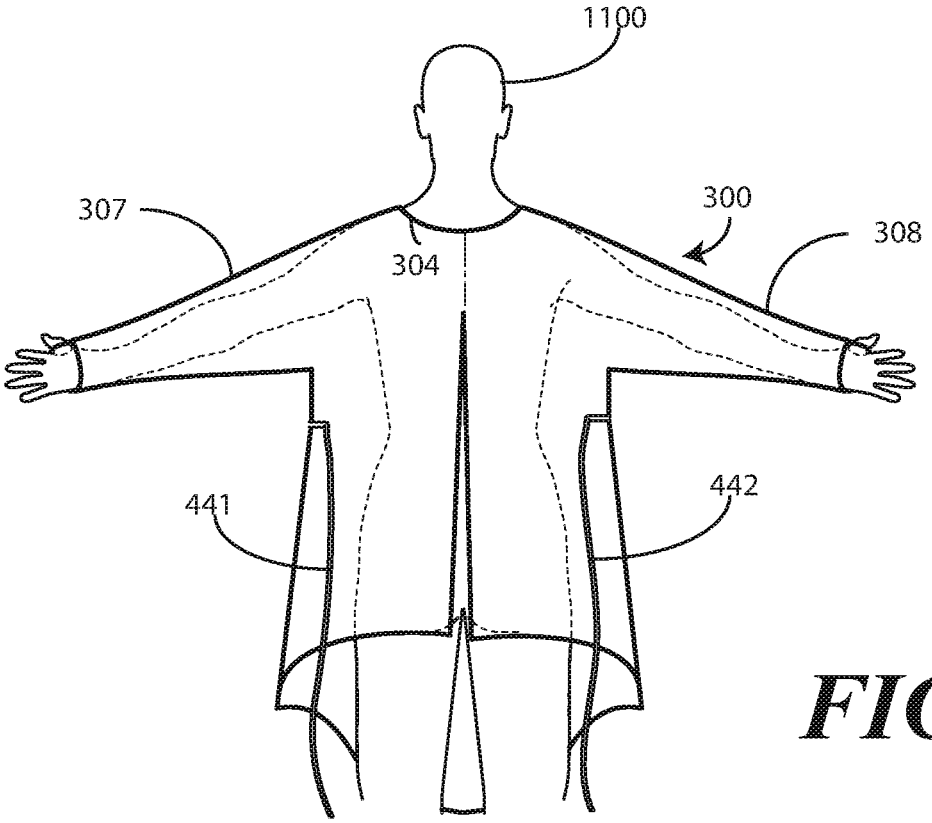
FIG. 11 illustrates a rear view of a user wearing another example of a gown configured in accordance with one or more embodiments of the invention prior to tying the tie members.
Figure 12:
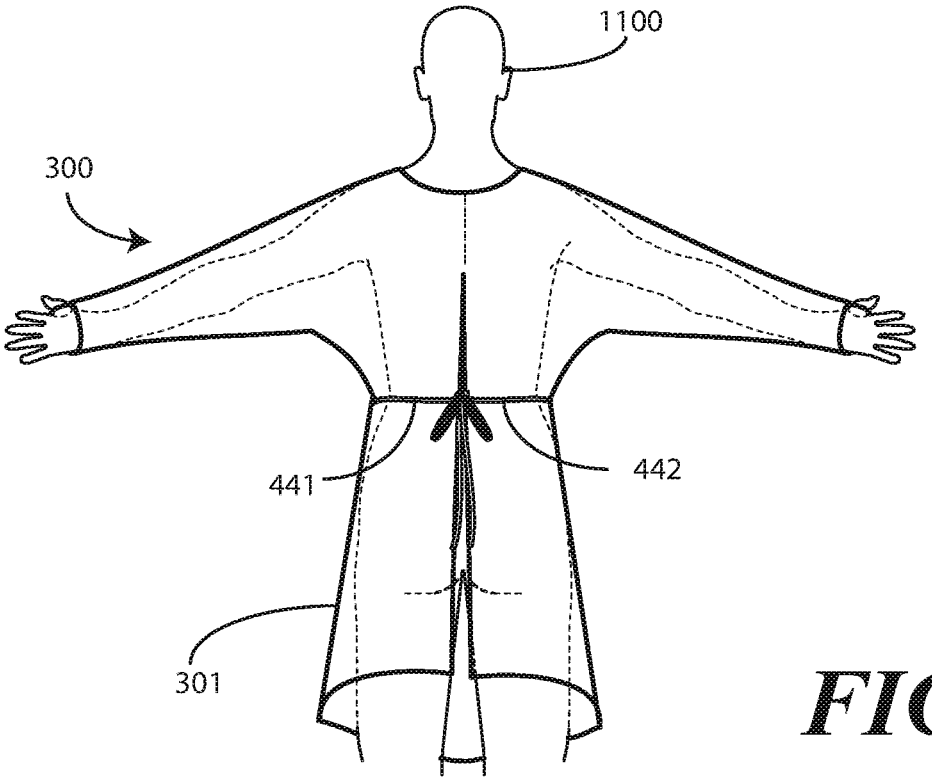
FIG. 12 illustrates a rear view of the user wearing another example of a gown configured in accordance with one or more embodiments of the invention after tying the tie members.

Turning now to FIGS. 11 and 12, a wearer 1100 can be seen donning the gown 300.

Specifically, the wearer 1100 has inserted his head into the head insertion aperture 304. Also, the wearer has inserted his arms into the arm insertion apertures (1007,1008). The wearer has inserted his thumbs into the thumb loops, thereby retaining the sleeves 307,308 snugly along each arm. The ties 441,442 are initially untied as shown in FIG. 11. Once tied, the ties 441,442 cinch the body covering portion 301 at the user's waist, as shown in FIG. 12.

Figure 13:
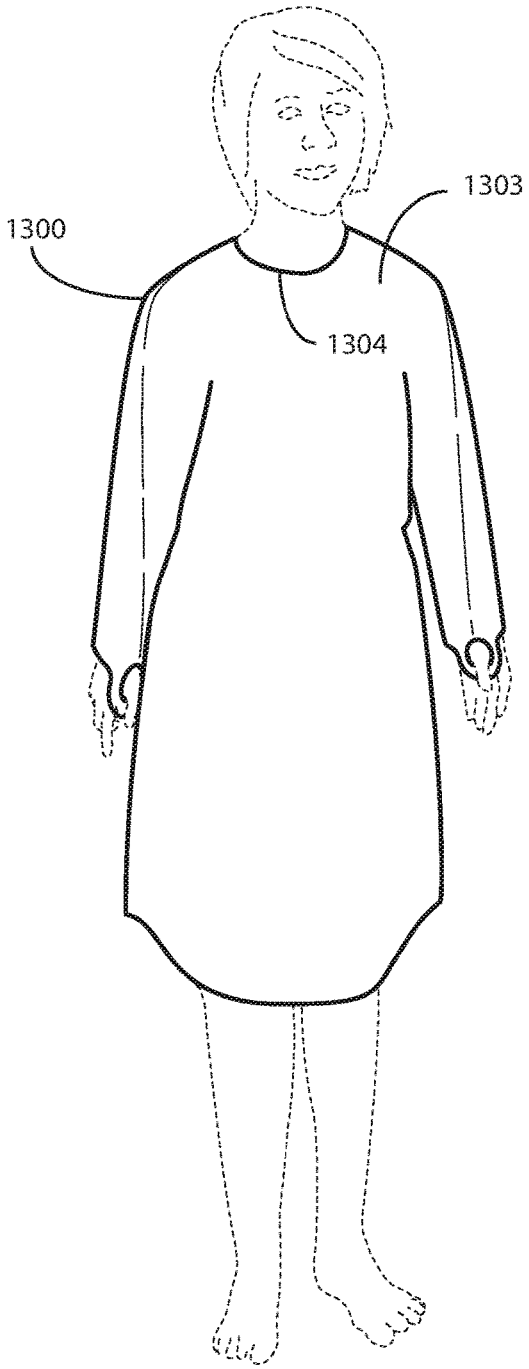
FIG. 13 illustrates another front view of a user wearing another example of a gown configured in accordance with one or more embodiments of the invention having tie members tied.
Figure 14:
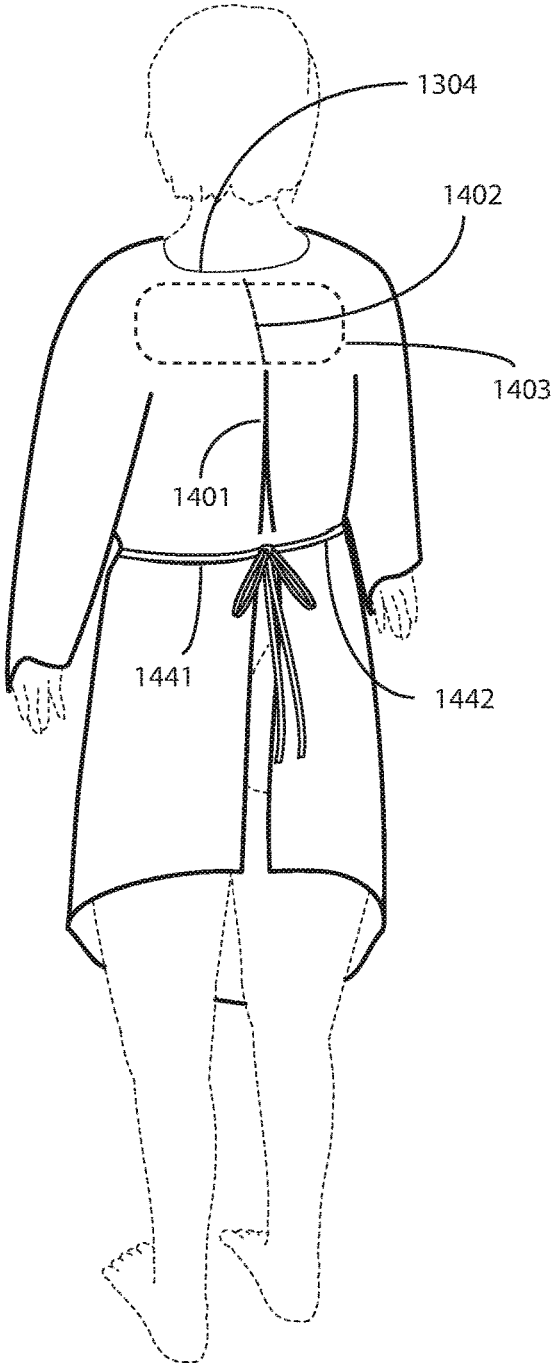
FIG. 14 illustrates another rear view of the user wearing another example of a gown configured in accordance with one or more embodiments of the invention having tie members tied.
Figure 15:
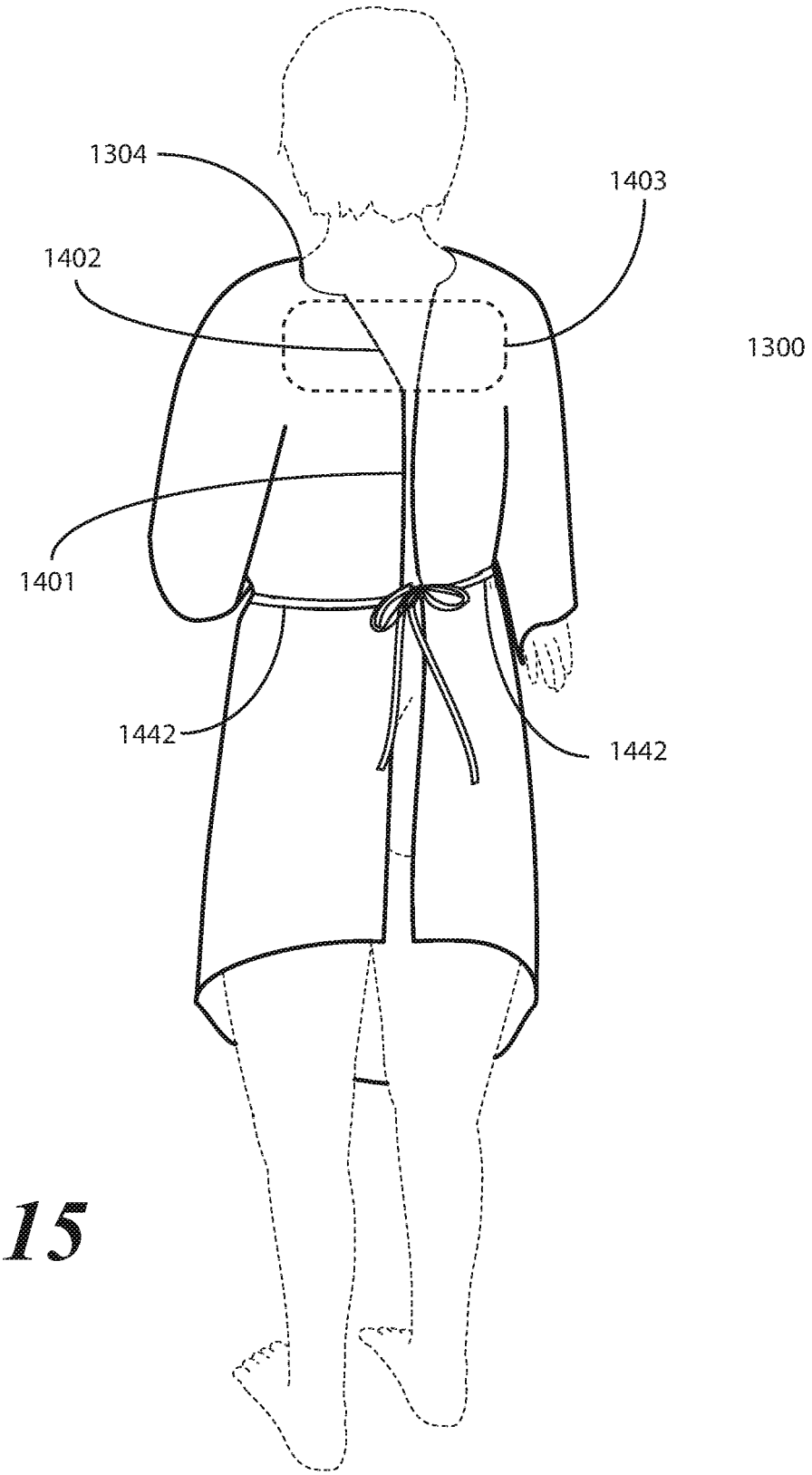
FIG. 15 illustrates a rear view of the user pulling on a front portion of another gown configured in accordance with one or more embodiments of the invention, thereby tearing a perforation to separate a rear portion of the gown.

Turning now to FIGS. 13-15, illustrated therein is a method of wearing and removing a gown 1300 in accordance with one or more embodiments of the invention. As shown in FIGS. 13 and 14, a user has accessed and donned the gown 1300. In this illustrative embodiment, the gown 1300 is manufactured from a non-woven fabric layer defining a neck opening 1304 between a front portion 1303 and a rear portion 1403. The rear portion 1403 includes a torso opening 1401 and a perforation 1402 extending across the rear portion 1403 at least partially between the torso opening 1401 and the neck opening 1304. The gown 1301 also includes one or more tie members 1441,1442 extending from the non-woven fabric layer. As shown in FIGS. 13 and 14, the user has passed her head through the neck opening 1304 and has tied the tie members 1441,1442 about her torso.

Turning now to FIG. 15, the user is now removing the gown 1300. Specifically, in this example she is using her left hand to grasp the front portion 1303 of the gown 1300. She then pulls it away from her torso. This causes the perforation 1402 to tear, thereby splitting the rear portion 1403 of the gown 1300. Where the gown 1300 is manufactured from non-woven material, this pulling action tears the perforation 1402 and splits the non-woven fabric layer between the neck opening 1304 and the torso opening 1401. The user can now simply drop the gown 1300 about her torso and step out of it. Where the tie members 1441,1442 are loosely tied, the pulling action can cause them to become untied, thereby facilitating simple removal of the gown 1300 with a simple stroke.

Figure 16:
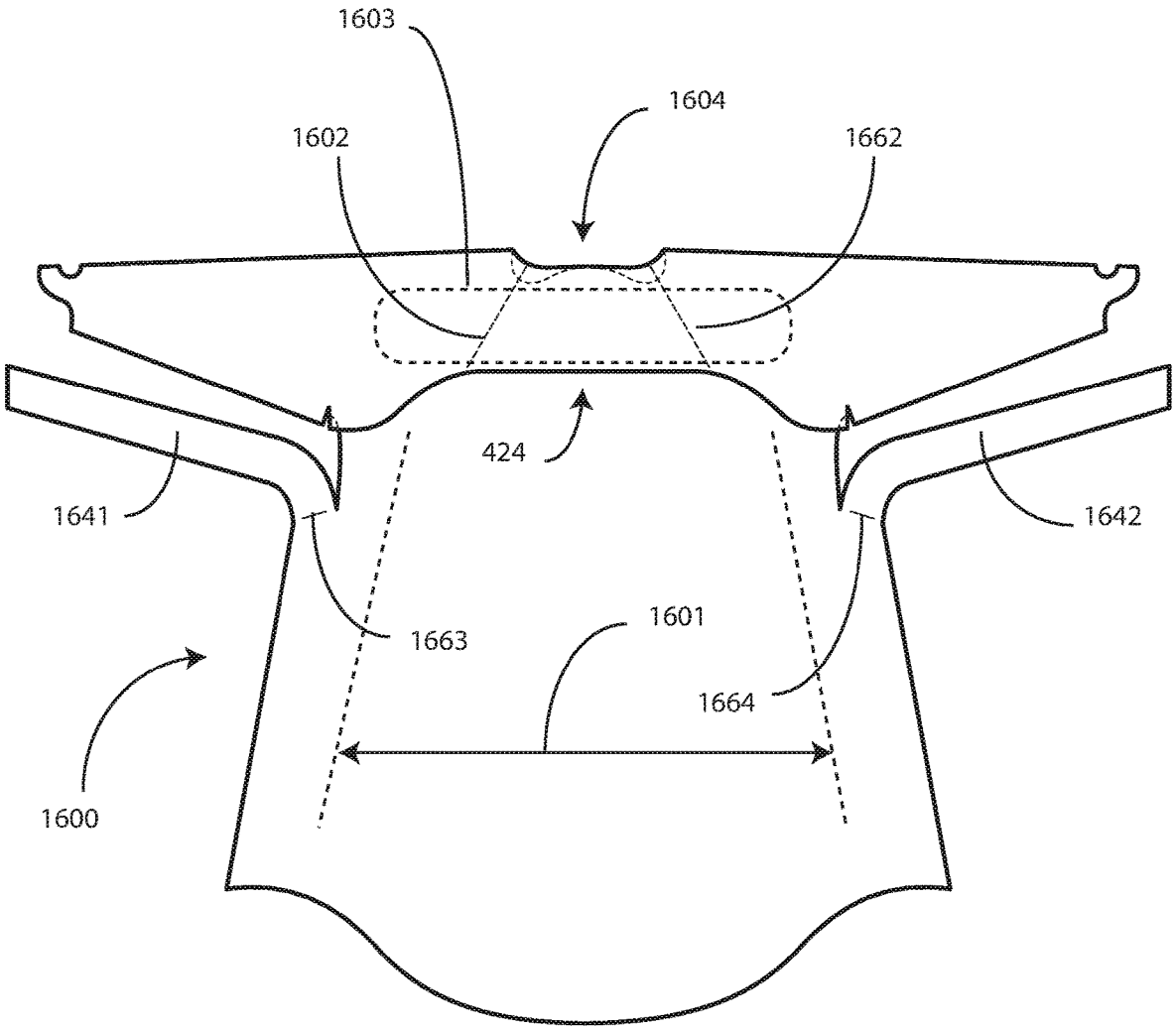
FIG. 16 illustrates a rear view of another example of a gown configured in accordance with one or more embodiments of the invention.
Figure 17:
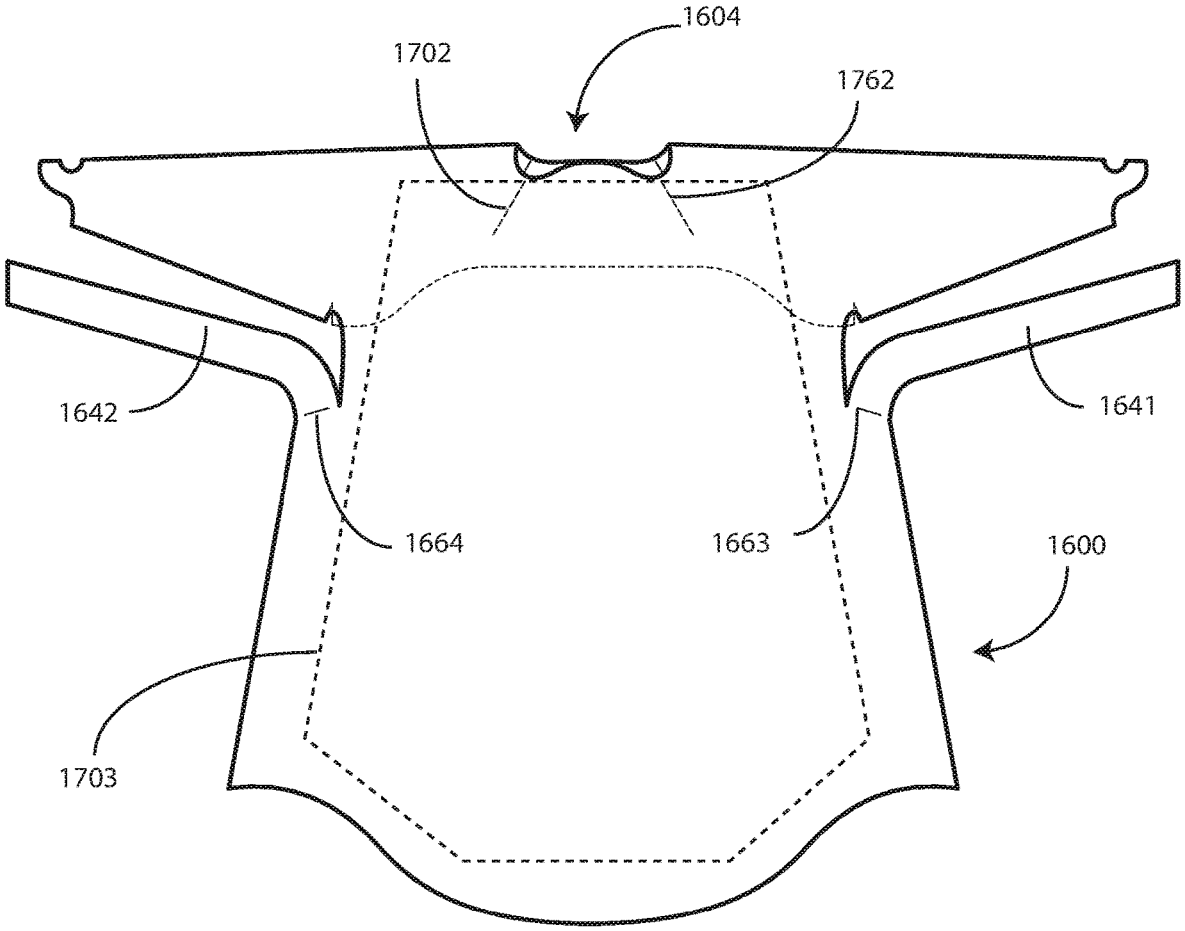
FIG. 17 illustrates a front view of another example of a gown configured in accordance with one or more embodiments of the invention.
Figure 18:
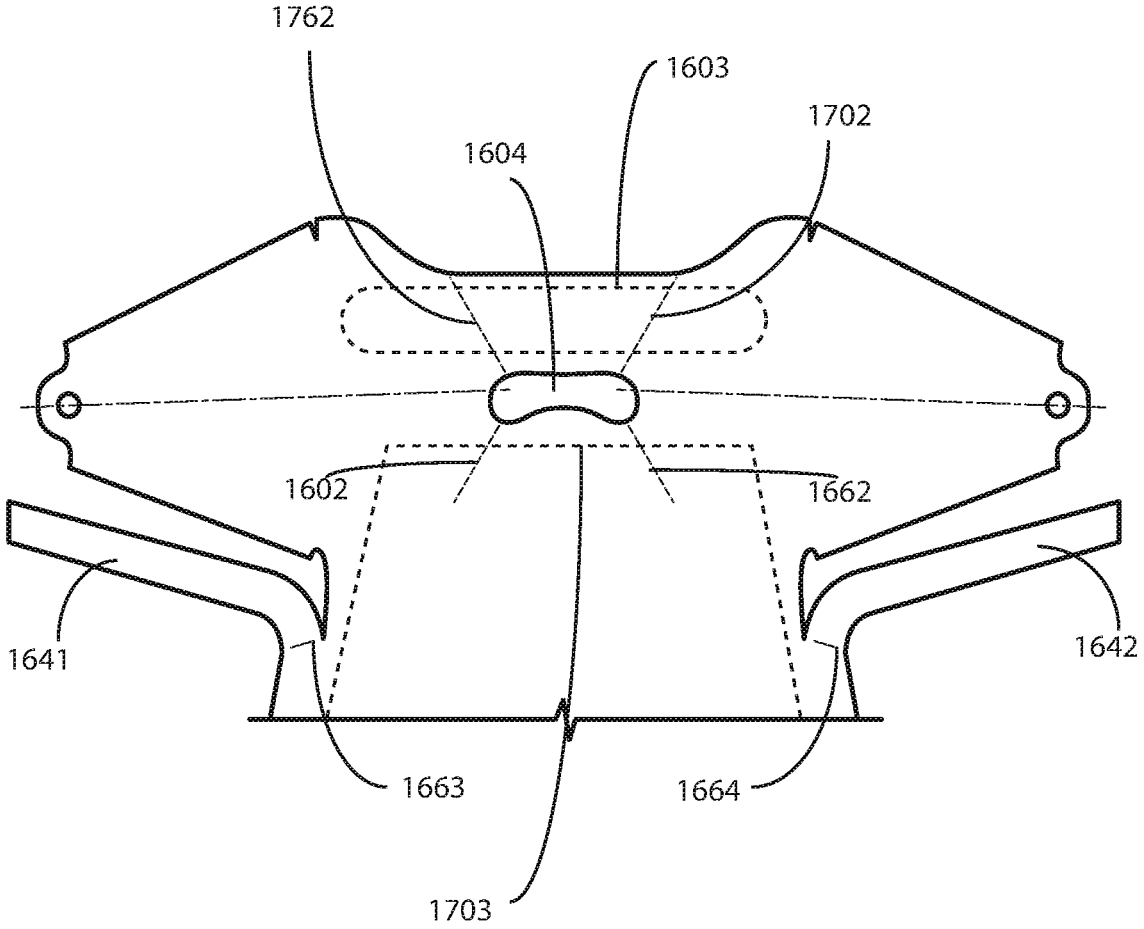
FIG. 18 shows a partial top view of another example of a gown configured in accordance with one or more embodiments of the invention.

Turning now to FIGS. 16-18, illustrated therein is another gown 1600 configured in accordance with one or more embodiments of the invention. FIG. 16 illustrates a rear view of the gown 1600, while FIG. 17 illustrates a front view of the gown 1600. FIG. 18 illustrates a top, plan view of a section of the gown 1600. As with the gown (300) of FIG. 3, the elements that medical gown 1600 shares with the gown (100) of FIGS. 1 and 2 will not be repeated in the description of medical gown 300 for brevity.

Figure 30:
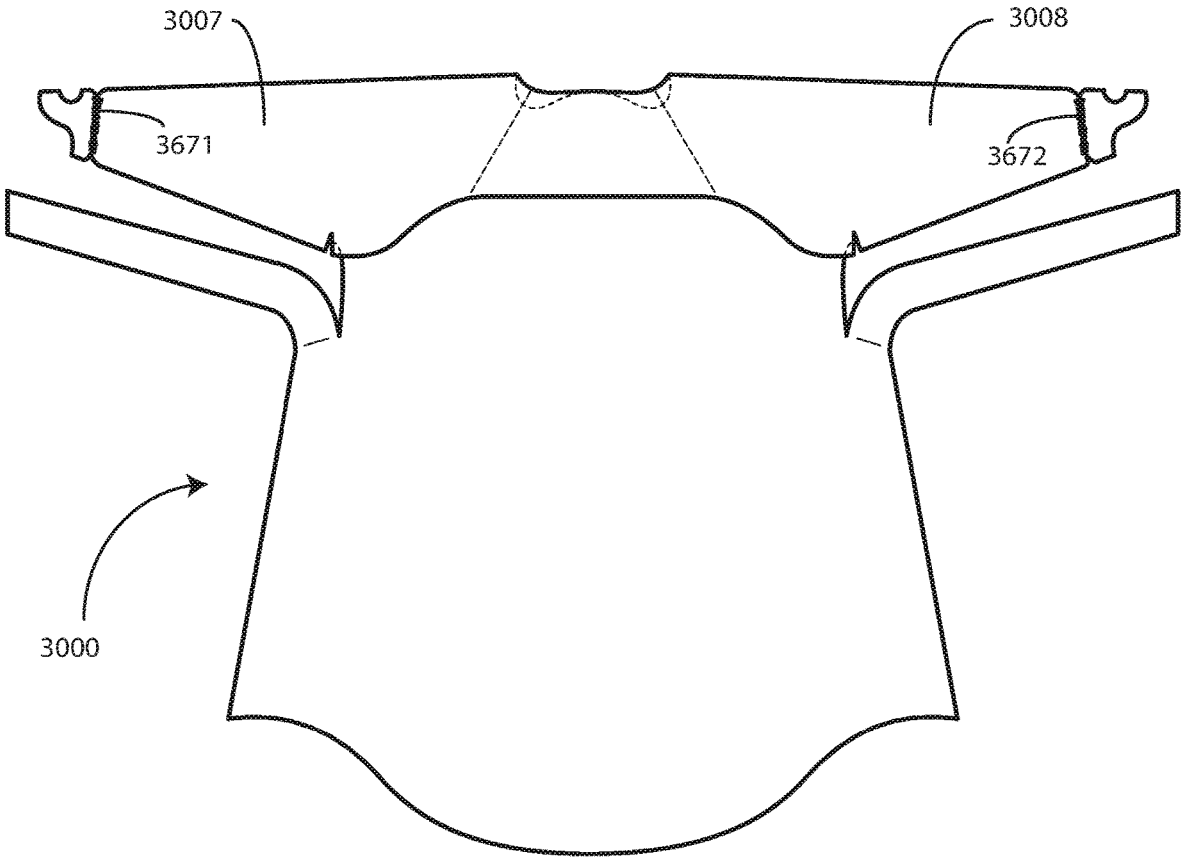
FIG. 30 illustrates a front view another example of a gown configured in accordance with one or more embodiments of the invention.

A first difference in the gown 1600 of FIGS. 16-18 is that the rear portion 1603 is substantially shorter than the front portion 1703. In this embodiment, the rear portion 1603 is configured to cover only portions of the shoulder blades of a wearer, and leave the remaining rear portions of the wearer's torso exposed. Accordingly, the opening 1601 is non-closable and arranged so as to leave exposed at least a six-inch width of a backside of the wearer when the first tie member 1641 and the second tie member 1642 are tied together about a torso of the wearer, as shown in FIG. 30. Such a configuration is suitable, for example, for proctology exams and other similar procedures.

Another difference is the contour of the head insertion aperture 1604. The rear side of the head insertion aperture 1604 has an angle-tapered flat contour, similar to that of FIG. 1. The front side of the head insertion aperture 1604 is concave-convex, with a major, central convex curvature centrally spanning two minor concave curvatures. The rear base member 424 is reverse angle-tapered flat, with two angular portions radially coming to a central member that is substantially flat.

Another difference in the gown 1600 of FIGS. 16-18 is that it includes a plurality of perforations 1602,1662,1702, 1762. Instead of having a single perforation, the gown 1600 includes two perforations 1602,1662 disposed along the rear portion 1603, and two perforations 1702,1762 disposed along the front portion. In the rear portion 1603, the perforations 1602,1662 are arranged so as to extend along the rear portion 1603 so as to diagonally cross at least parts of shoulder blades of the wearer. In the front portion 1703, the perforations 1702,1762 extend across the front portion 1703 diagonally between the head insertion aperture 1604 and the sleeves or the arm insertion apertures.

Yet another difference in the gown 1600 from previous embodiments is that the tie members 1641,1642 are integral with the body covering portion 1701. Said differently, the same material from which the body covering portion 1701 is made is used to make the tie members 1641,1642, as the tie members 1641,1642 are simply extensions of that material. Additionally, in the illustrative embodiment of FIGS. 16-18, the tie members 1641,1642 are "tearable" due to a score line 1663,1664 extending across a width portion of the tie members at an interface of the tie members 1641,1642 with the body covering portion 1703. In one embodiment, the score lines 1663,1664 are non-linear and measure between one and three inches in length.

Figure 19:
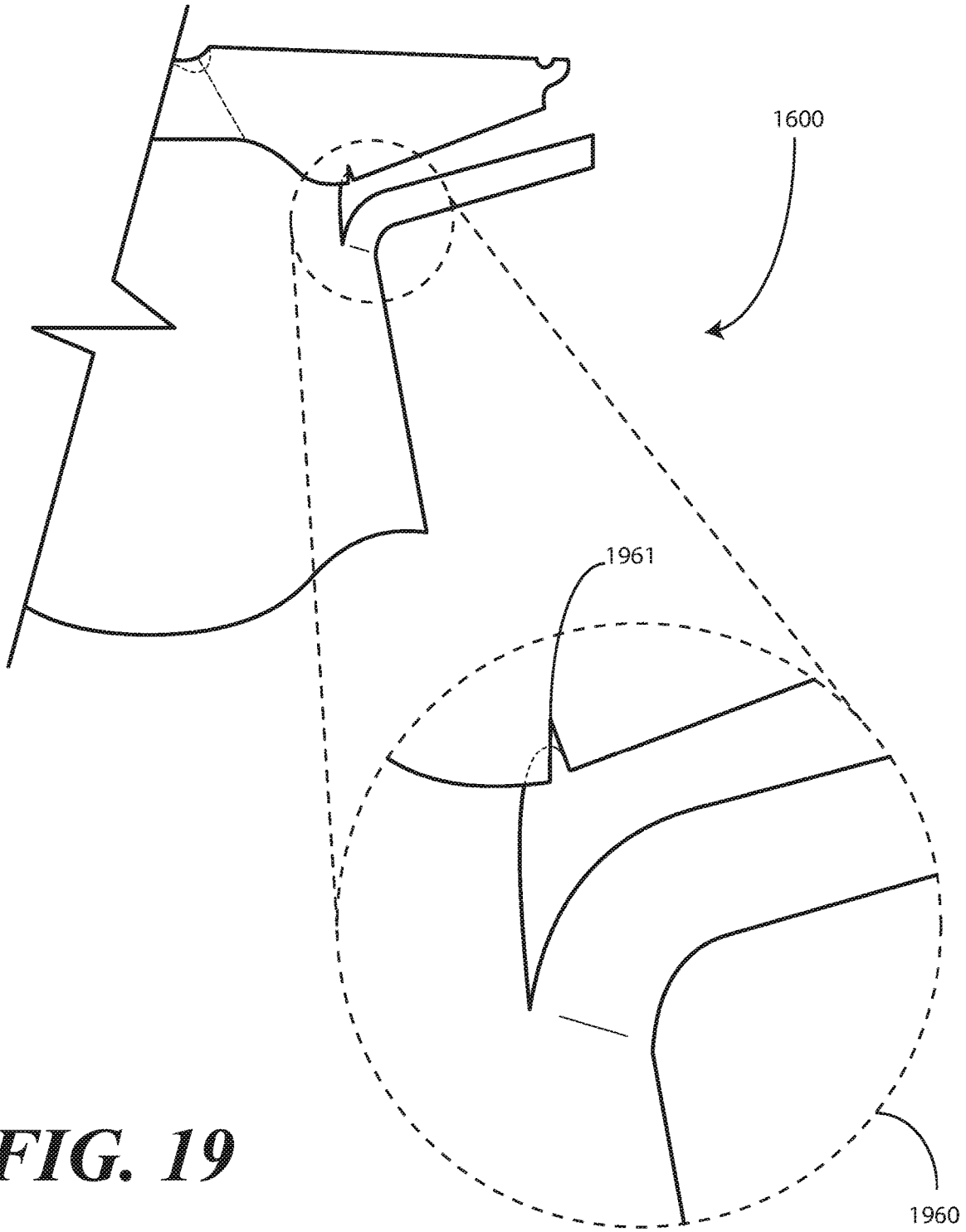
FIG. 19 shows a close-up, rear underarm portion of a gown configured in accordance with one or more embodiments of the invention.
Figure 20:
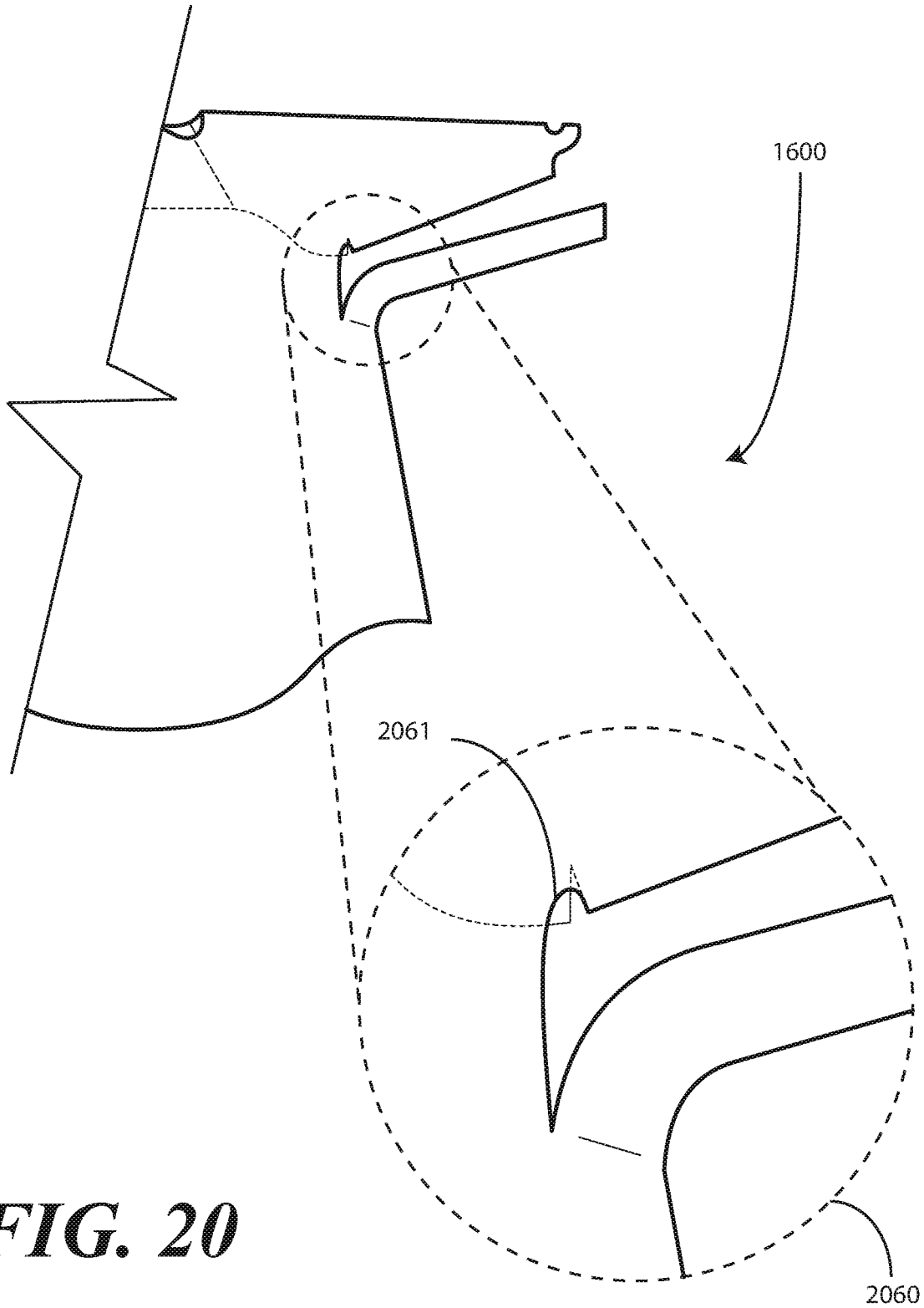
FIG. 20 illustrates a close-up, front underarm portion of a gown configured in accordance with one or more embodiments of the invention.

Turning now to FIGS. 19 and 20, illustrated therein is another difference between the gown 1600 and previous embodiments. FIG. 19 shows a rear view of the gown 1600, with a rear underarm area 1960 shown in an expanded view. FIG. 20 shows a front view of the gown, with a front underarm area 2060 shown in an expanded view.

The gown includes a loop-check configuration with the rear underarm area 1960 including a check indention 1961. The front underarm area 2060 has a corresponding loop 2061 co-aligned with the check indention 1961 so that the two at least partially overlap when the gown 1900 is pressed flat.

Figure 21:
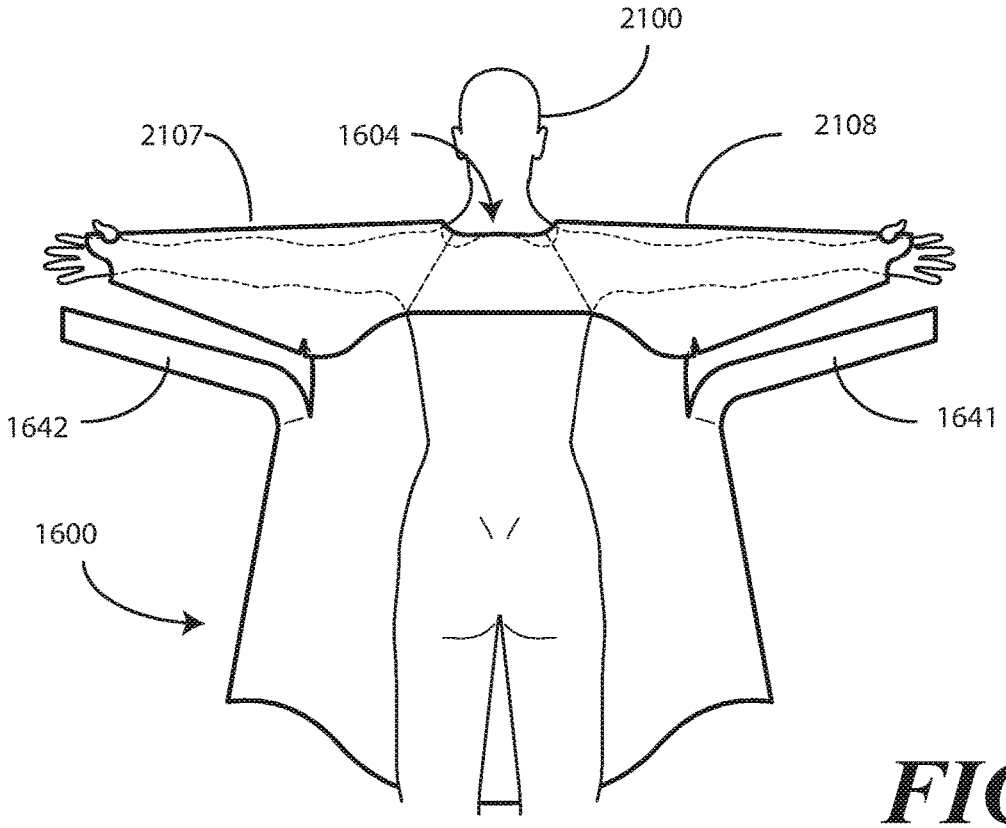
FIG. 21 illustrates a rear view of a user wearing another example of a gown configured in accordance with one or more embodiments of the invention prior to tying the tie members.
Figure 22:
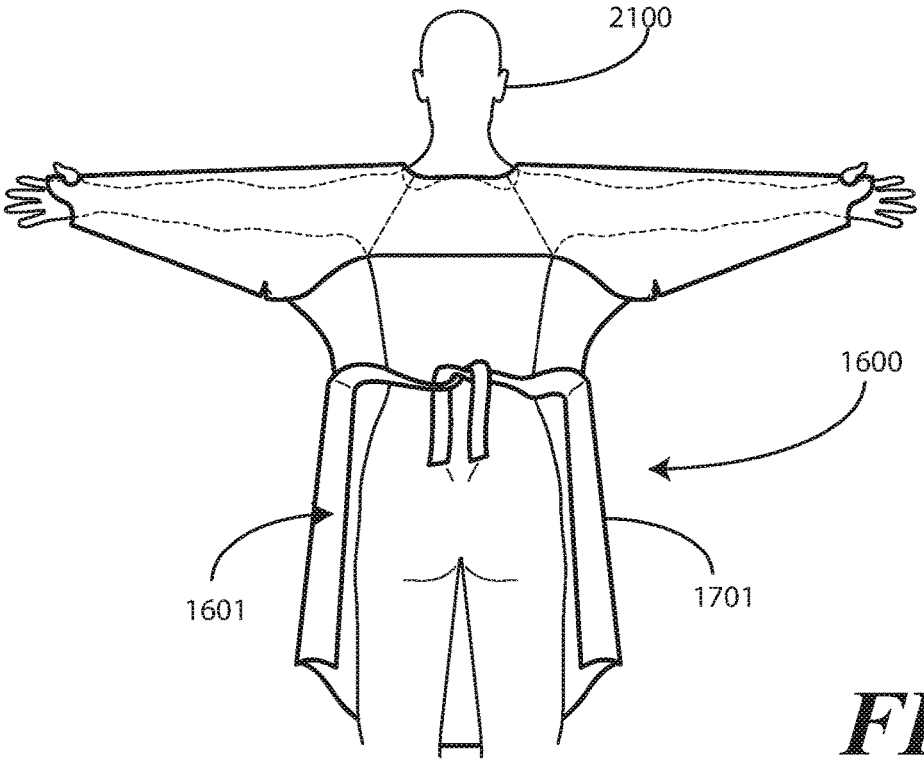
FIG. 22 illustrates a rear view of the user wearing another example of a gown configured in accordance with one or more embodiments of the invention after tying the tie members.

Turning now to FIGS. 21 and 22, a wearer 2100 can be seen donning the gown 1600. Specifically, the wearer 2100 has inserted his head into the head insertion aperture 1604. Also, the wearer has inserted his arms into the arm insertion apertures. The wearer has inserted his thumbs into the thumb loops, thereby retaining the sleeves 2107,2108 snugly along each arm. The tie members 1641,1642 are initially untied as shown in FIG. 21. Once tied, the tie members 1641,1642 cinch the body covering portion 1701 about the torso, as shown in FIG. 22. However, due to the non-closable opening 1601 at least a six-inch width of the wearer's backside s exposed when the first tie member 1641 and the second tie member 1642 are tied together about a torso of the wearer 2100.

Figure 23:
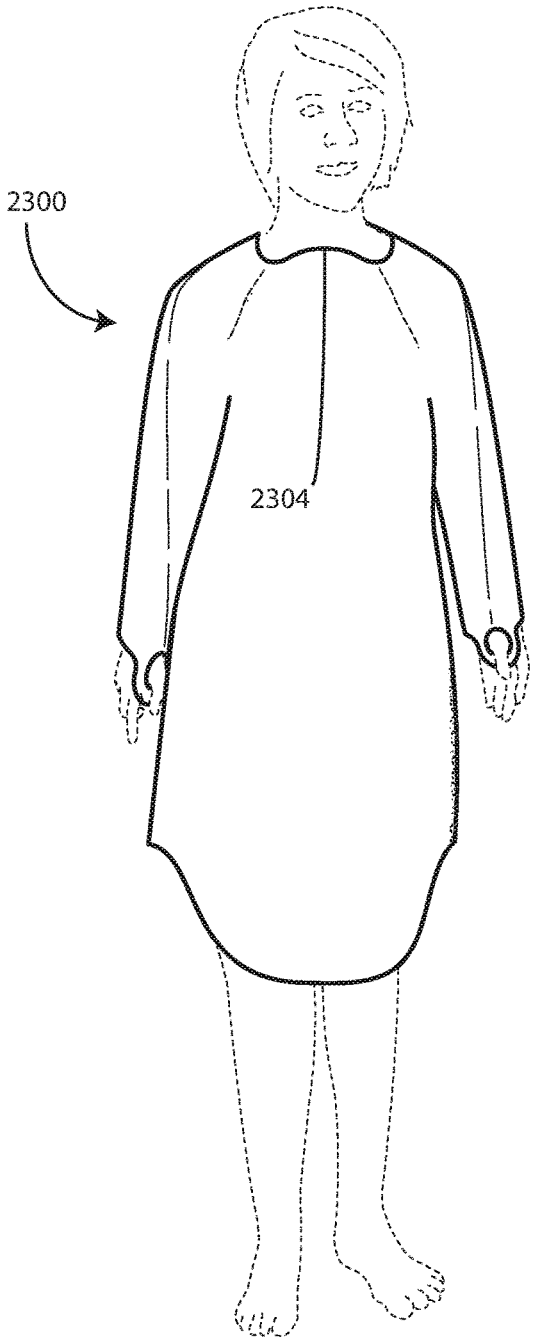
FIG. 23 illustrates another front view of a user wearing another example of a gown configured in accordance with one or more embodiments of the invention having tie members tied.
Figure 24:
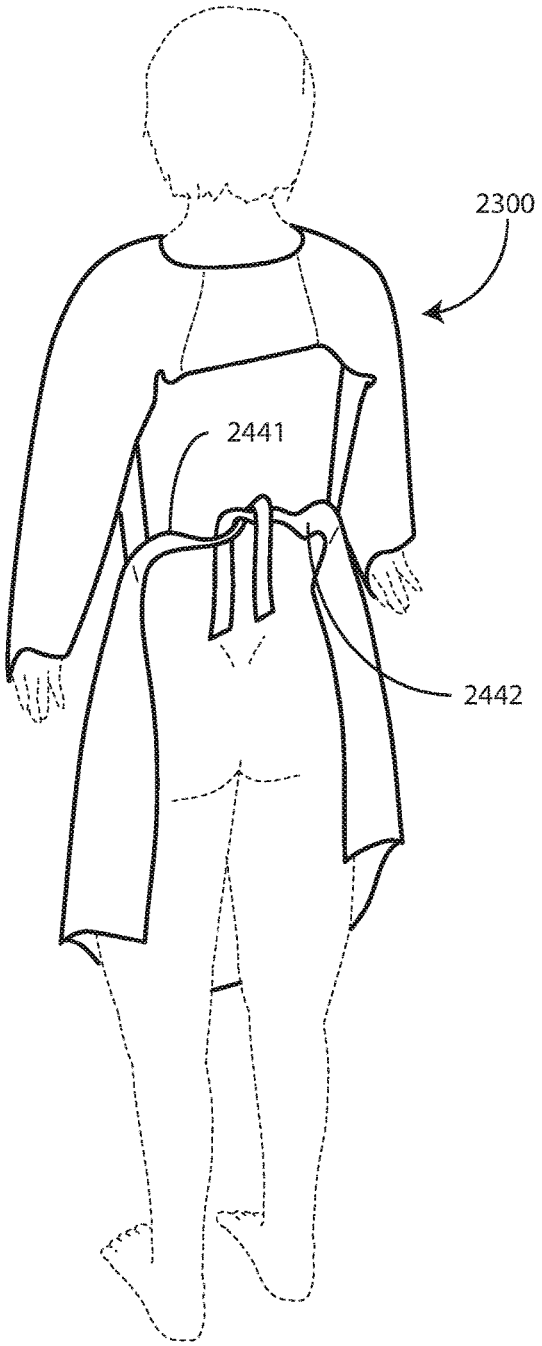
FIG. 24 illustrates another rear view of the user wearing another example of a gown configured in accordance with one or more embodiments of the invention having tie members tied.
Figure 25:
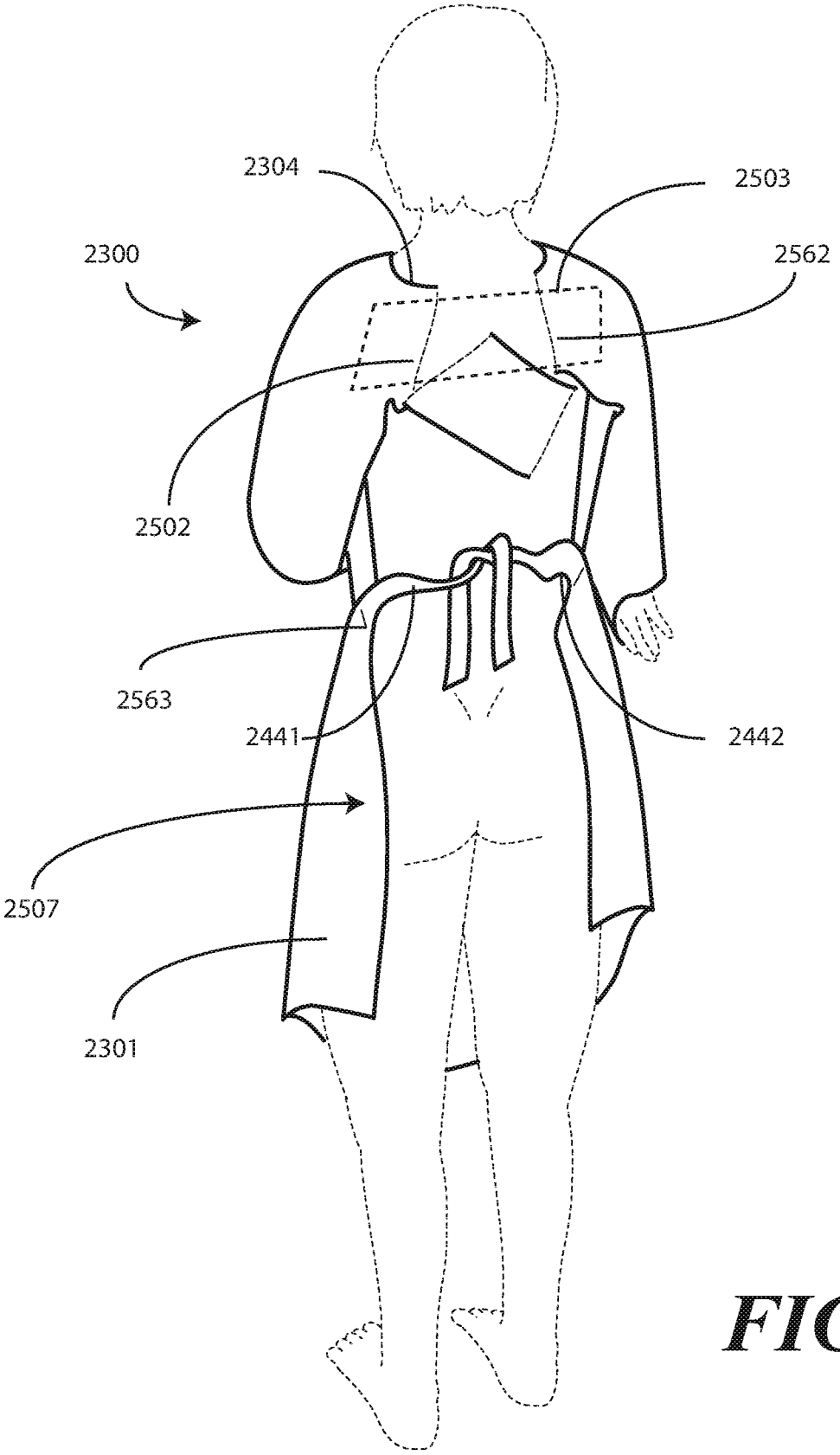
FIG. 25 illustrates a rear view of the user pulling on a front portion of another gown configured in accordance with one or more embodiments of the invention, thereby tearing a perforation to separate a rear portion of the gown.

Turning now to FIGS. 23-25, illustrated therein is a method of wearing and removing a gown 2300 in accordance with one or more embodiments of the invention. As shown in FIGS. 23 and 24, a user has accessed and donned the gown 2300. The user has passed her head through the neck opening 2404 and has tied the tie members 2441,2442 about her torso.

Turning now to FIG. 25, the user is now removing the gown 2300. Specifically, in this example she is using her left hand to grasp the front portion of the gown 2300. She then pulls it away from her torso. This causes the perforations 2502,2562 to tear, thereby splitting the rear portion 2503 of the gown 2300. This pulling action tears the perforations 2502,2562 and splits the rear portion 2503 between the neck opening 2304 and the opening 2501. The pulling action also separates the score 2563, thereby severing one or both tie members 2441,2442 from the body covering portion 2301, thereby facilitating simple removal of the gown 2300 with a simple stroke.

Figure 26:
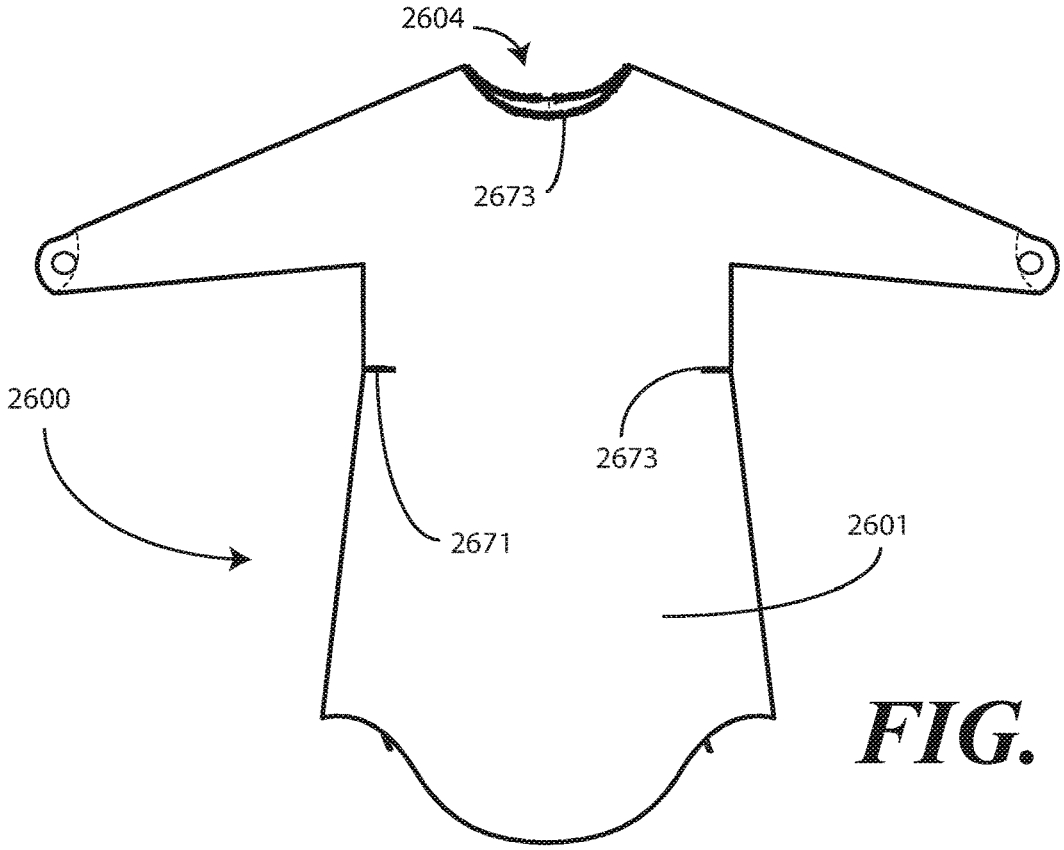
FIG. 26 illustrates a front view another example of a gown configured in accordance with one or more embodiments of the invention.
Figure 27:
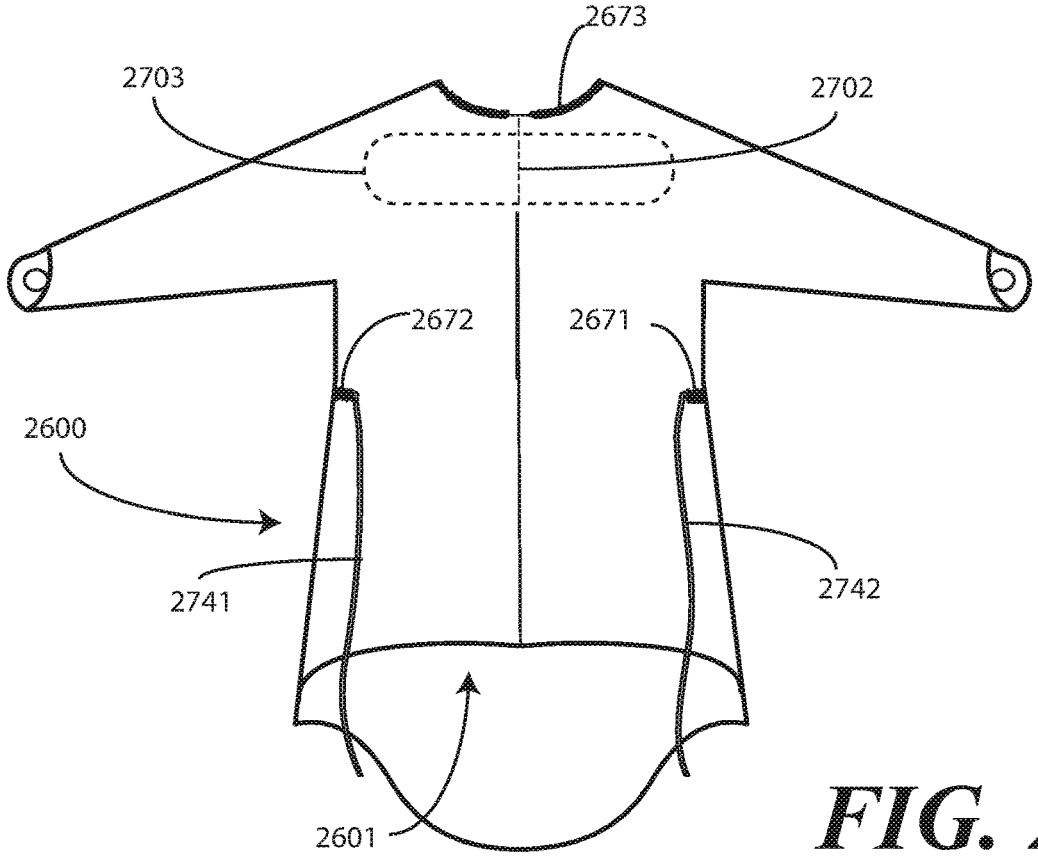
FIG. 27 illustrates a rear view of another example of a gown configured in accordance with one or more embodiments of the invention.

Turning now to FIGS. 26-27, illustrated therein is yet another embodiment of a gown 2600 configured in accordance with one or more embodiments of the invention. The gown 2600 of FIGS. 26-27 is similar to that of FIGS. 3 and 4. However, the gown 2600 of FIGS. 26-27 is configured with compliant gathering devices to help hold the gown 2600 more securely about the torso of the wearer.

Specifically, in this illustrative embodiment, the gown 2600 includes elastic gatherings, with an elastic gathering 2671,2672 being disposed at an attachment interface between a tie member 2741,2742 and the body covering portion 2601 of the gown 2600. In this configuration, the elastic gatherings are disposed so as to gather portions of the body covering portion 2601 about a waist of the wearer. In this illustrative embodiment, each elastic gathering is between about one and about three inches in length.

In one embodiment, the elastic gatherings 2671,2672 are integral with the body covering portion 2601, with any elastic or retractable material of the elastic gatherings 2671, 2672 being attached to the body covering portion 2601. In this embodiment, the tie members are attached to the body covering portion 2601, at or near the elastic gatherings 2671,2672, with only the tie members extending distally away from the body covering portion 2601. In this embodiment, the elastic gatherings 2671,2672 may be fully attached to the body covering portion 2601 such that they do not extend away from the body covering portion 2601.

In another embodiment, each elastic gathering 2671,2672 is integral with each tie member so as to form an axial extension of the tie member. Said differently, in this embodiment, only a portion of each elastic gathering 2671,2672 is attached to the body covering portion 2601, with the remainder of the elastic gathering 2671,2672 extending distally away from the body covering portion 2601. The elastic gatherings 2671,2672 can extend distally away from the body covering portion 2601 in an axial relationship with each tie member, such that when each tie member is pulled, it "stretches" away from the body covering portion 2601. Other embodiments will be obvious to those of ordinary skill in the art having the benefit of this disclosure.

The gown 2600 also includes an elastic strip 2673 disposed about at least a portion of the head insertion aperture 2604. In this illustrative embodiment, the elastic strip 2673 spans between 80 and 95 percent of the perimeter of the head insertion aperture 2604, stopping on either side of the perforation 2702 to allow easier separation of the rear portion 2703 when the perforation 2702 is torn. The elastic strip 2673 is accordingly configured to gather the head insertion aperture 2604 about a neck of the wearer.

Figure 28:
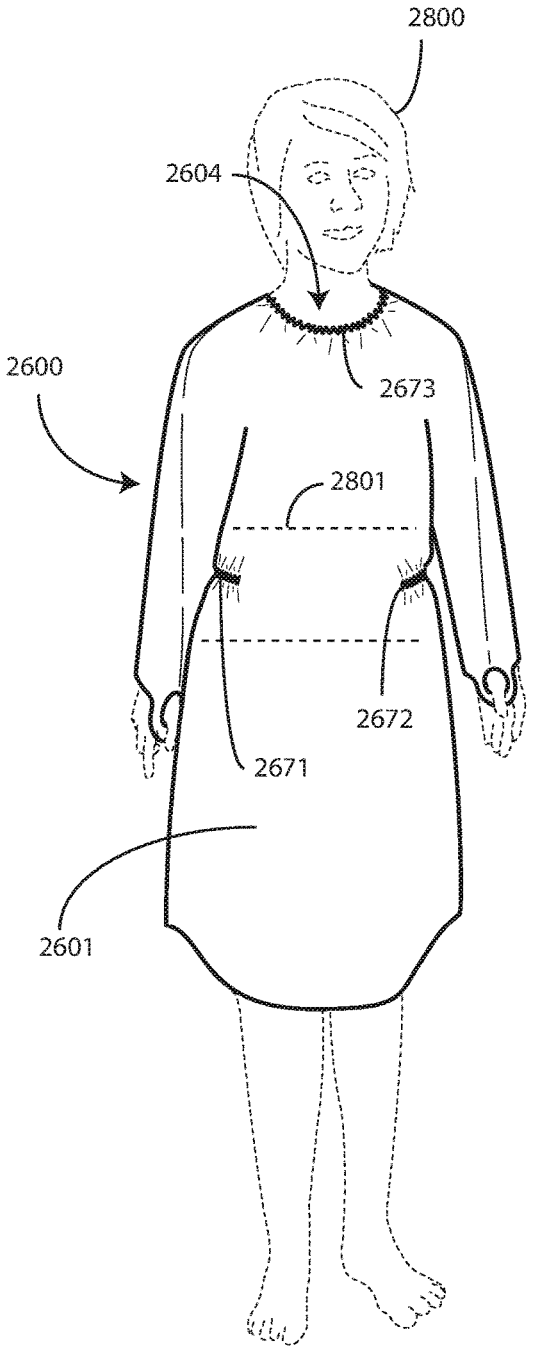
FIG. 28 illustrates another front view of a user wearing another example of a gown configured in accordance with one or more embodiments of the invention having tie members tied.
Figure 29:
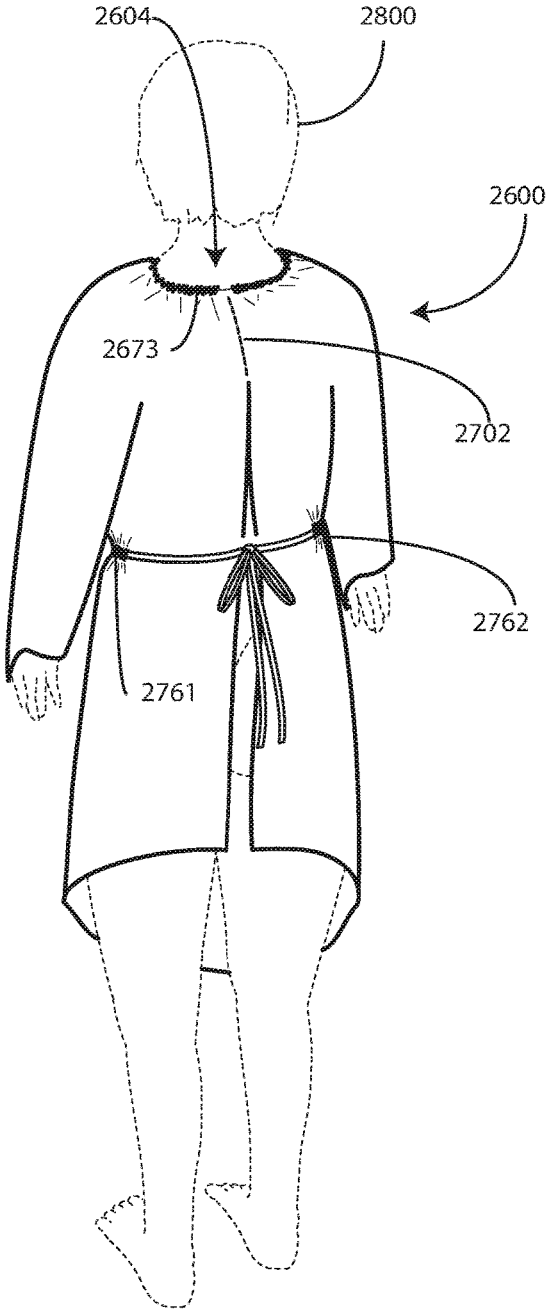
FIG. 29 illustrates another rear view of the user wearing another example of a gown configured in accordance with one or more embodiments of the invention having tie members tied.

Turning to FIGS. 28 and 29, illustrated therein is a user 2800 wearing the gown 2600. As shown, each elastic gathering 2671,2672 gathers portions of the body covering portion 2601 about a waist 2801 of the user 2800. Similarly, the elastic strip 2673 gathers the head insertion aperture 2604 about a neck of the user 2800, while still allowing the perforation 2702 to be torn when the user removes the gown 2600.

Figure 31:
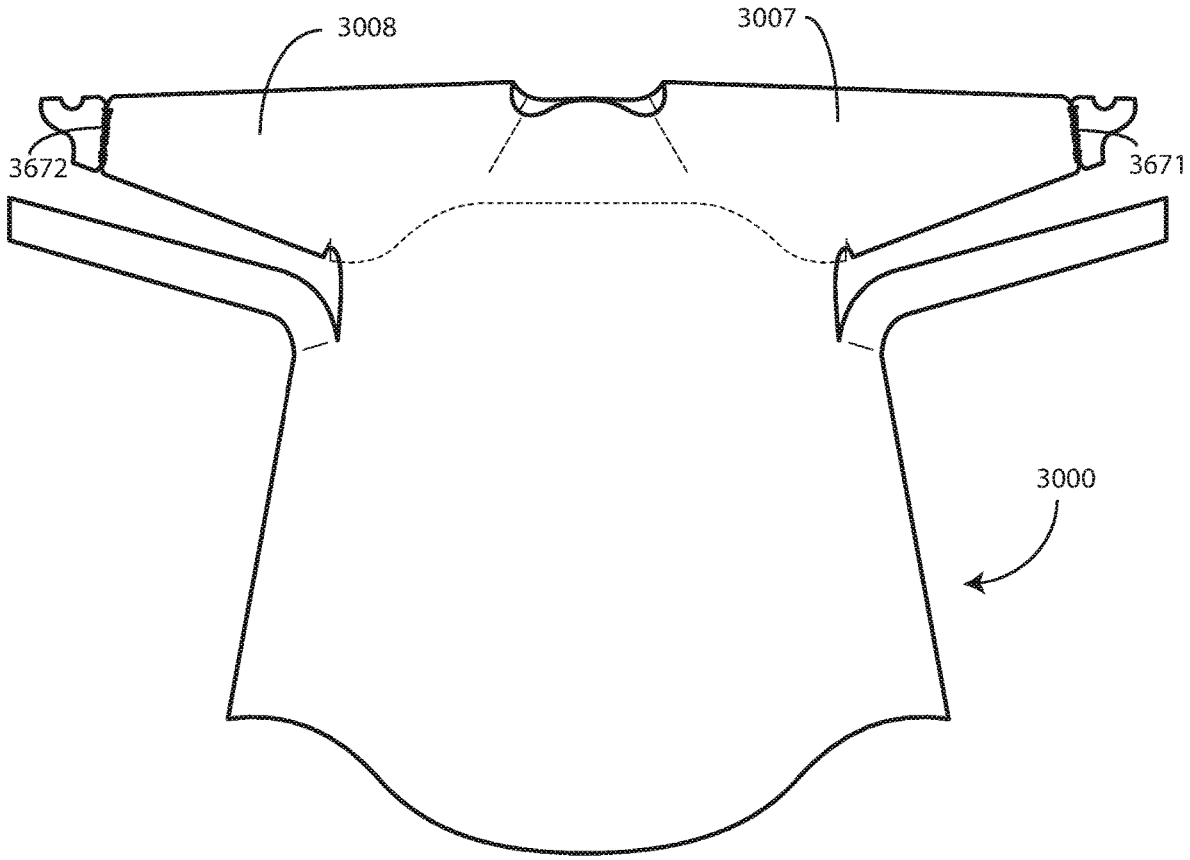
FIG. 31 illustrates a rear view of another example of a gown configured in accordance with one or more embodiments of the invention.

Turning now to FIGS. 30-31, illustrated therein is another gown 3000 configured in accordance with one or more embodiments of the invention. FIG. 30 illustrates a rear view of the gown 3000, while FIG. 31 illustrates a front view of the gown 3000. The gown 300 is similar to the gown (1600) shown in FIGS. 16-18. Elements that gown 3000 shares with the gown (1600) of FIGS. 16-18 will not be repeated in the description of gown 3000 for brevity.

A primary difference between the gown (1600) of FIGS. 16-18 and the gown 3000 of FIGS. 30-31 is that the arms 3007,3008 include elastic gatherings 3671,3672 about the wrists. Each elastic gathering 3671,3672 gathers portions of the arms 3007,3008 about wrists of a user.

Figure 32:
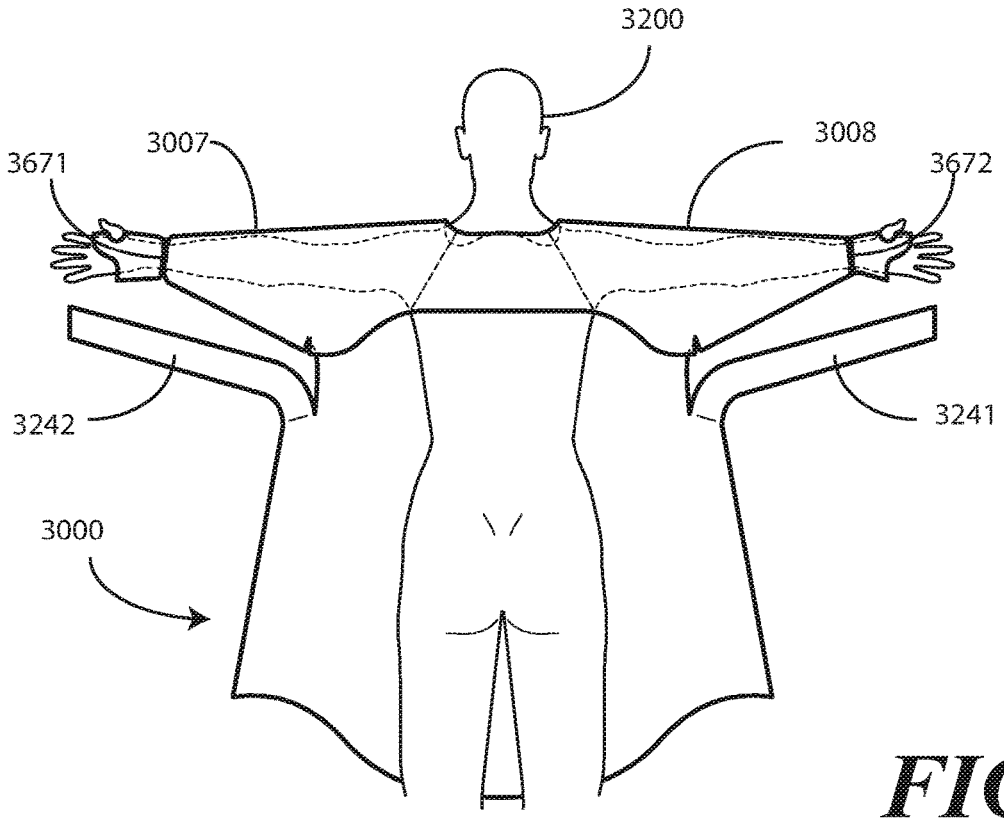
FIG. 32 illustrates a rear view of a user wearing another example of a gown configured in accordance with one or more embodiments of the invention prior to tying the tie members.
Figure 33:
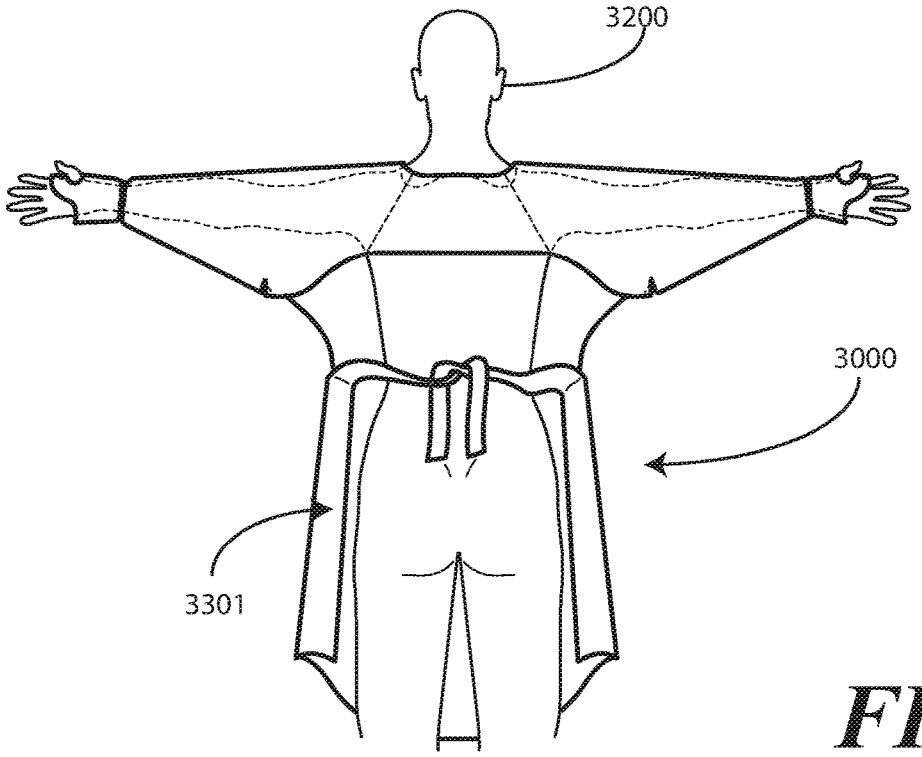
FIG. 33 illustrates a rear view of the user wearing another example of a gown configured in accordance with one or more embodiments of the invention after tying the tie members.

Turning now to FIGS. 32 and 33, a wearer 3200 can be seen donning the gown 3000 of FIGS. 30 and 31. Specifically, the wearer 3200 has inserted his head into the head insertion aperture. Also, the wearer has inserted his arms into the arm insertion apertures. The elastic gatherings 3671,3672 of the sleeves 3007,3008 gather the sleeves 3007,3008 about the wrists of the wearer 3200. The wearer 3200 has inserted his thumbs into the thumb loops. The combination of thumb loop and elastic gathering 3671,3672 work together to retain the sleeves 3007,3008 snugly along each arm. The tie members 3241,3242 are initially untied as shown in FIG. 32. Once tied, the tie members 3241,3242 cinch the body covering portion 3301 about the torso, as shown in FIG. 33.

Figure 34:
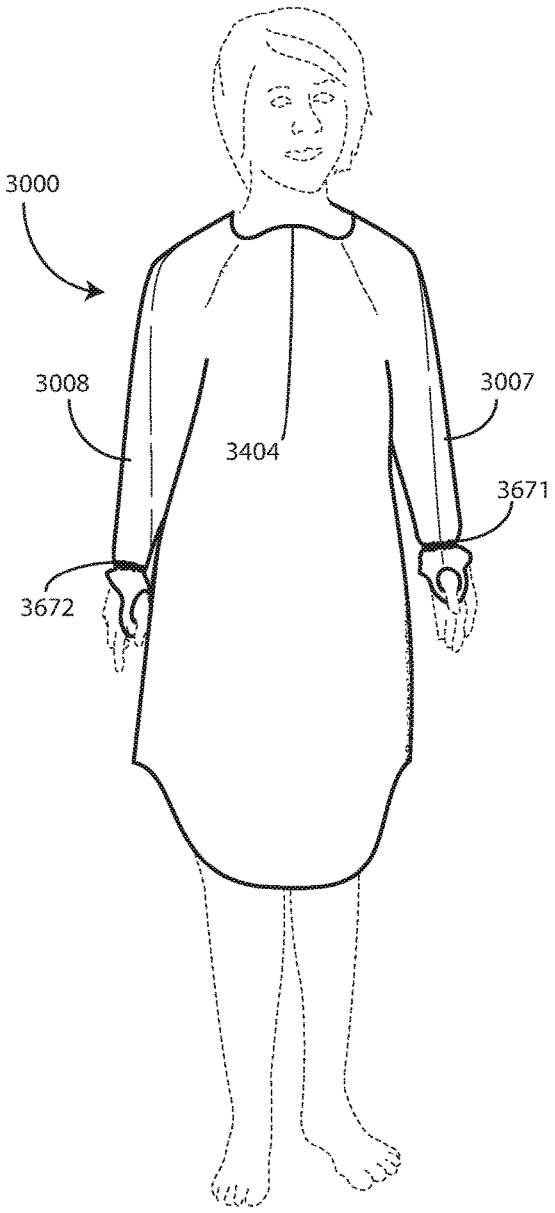
FIG. 34 illustrates another front view of a user wearing another example of a gown configured in accordance with one or more embodiments of the invention having tie members tied.
Figure 35:
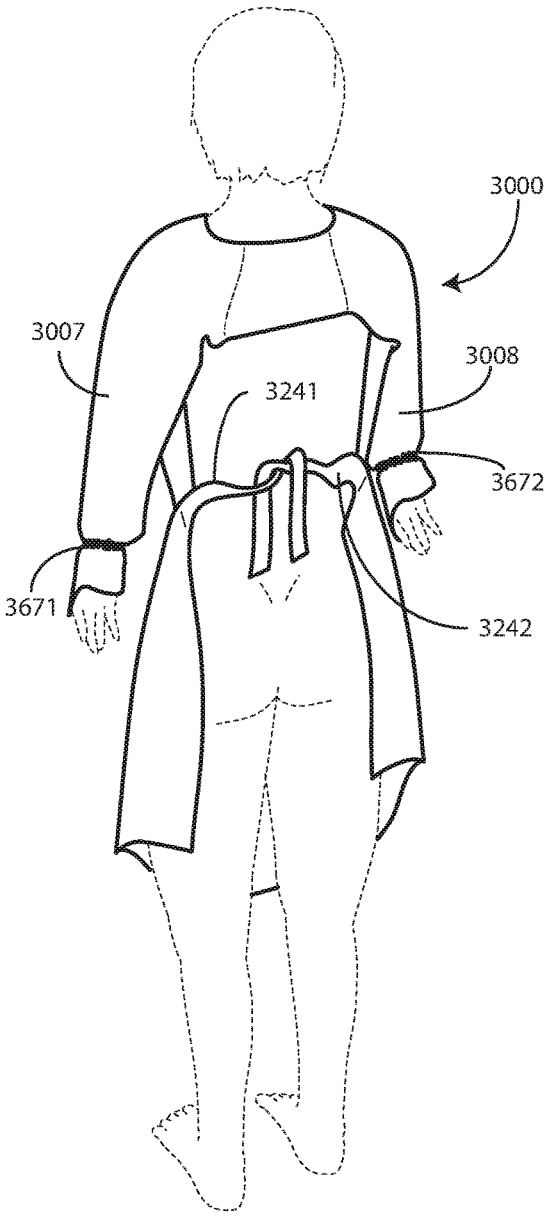
FIG. 35 illustrates another rear view of the user wearing another example of a gown configured in accordance with one or more embodiments of the invention having tie members tied.

Turning now to FIGS. 34-35, illustrated therein is a method of wearing and removing a gown 3000 in accordance with one or more embodiments of the invention. As shown in FIG. 34, a user has accessed and donned the gown 2300, with the elastic gatherings 3671,3672 gathering the sleeves 3007,3008 about her wrists. The user has passed her head through the neck opening 3404 and has tied the tie members 3241,3242 about her torso. The gown 3000 can then be removed in a manner similar to that described above with reference to FIG. 25.

Figure 36:
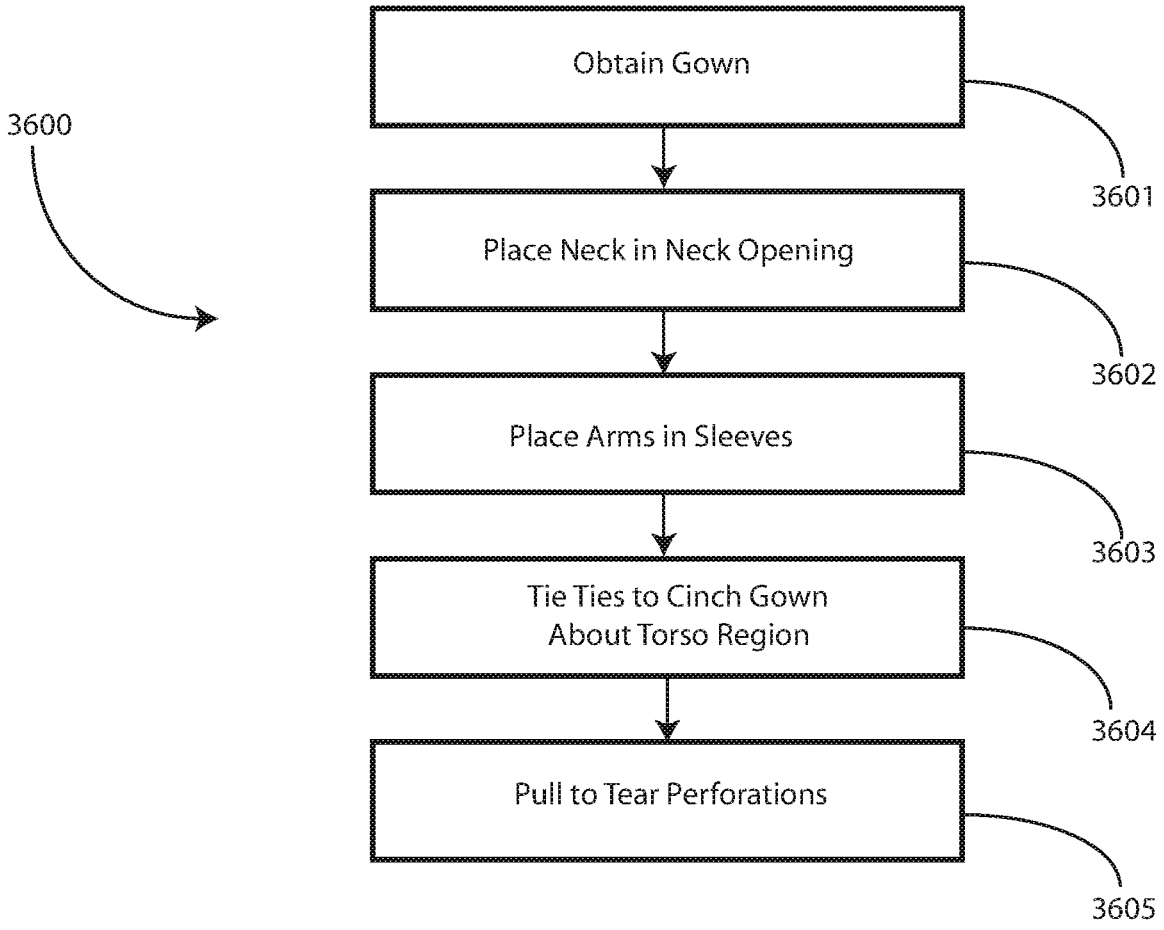
FIG. 36 illustrates one method of wearing and removing a gown in accordance with one or more embodiments of the invention.

Turning now to FIG. 36, illustrated therein is a flow chart of a method 3600 wearing and removing a gown suitable with various gown embodiments described above. At step 3601, a user accesses a gown configured in accordance with one of the embodiments above. As noted, the gown can include a non-woven fabric layer defining a neck opening between a portion and a rear portion, wherein the rear portion defines a torso opening. The gown can further include one or more perforations extending across the rear portion at least partially between the opening and the neck opening, and one or more tie members extending from the non-woven fabric layer.

At step 3602, the user places their head in the neck opening. At step 3603, the user places their arms in the sleeves. At step 3604, the user ties one or more tie members about their torso, thereby fully donning the gown.

To remove the gown, at step 3605, the user pulls the front portion of the material. In one embodiment, this pulling action tears the one or more perforations and splits the material between the neck opening and the opening. In one embodiment, this also severs one or more of the tie members from a body covering portion, thereby allowing the gown to be easily removed.

Figure 37:
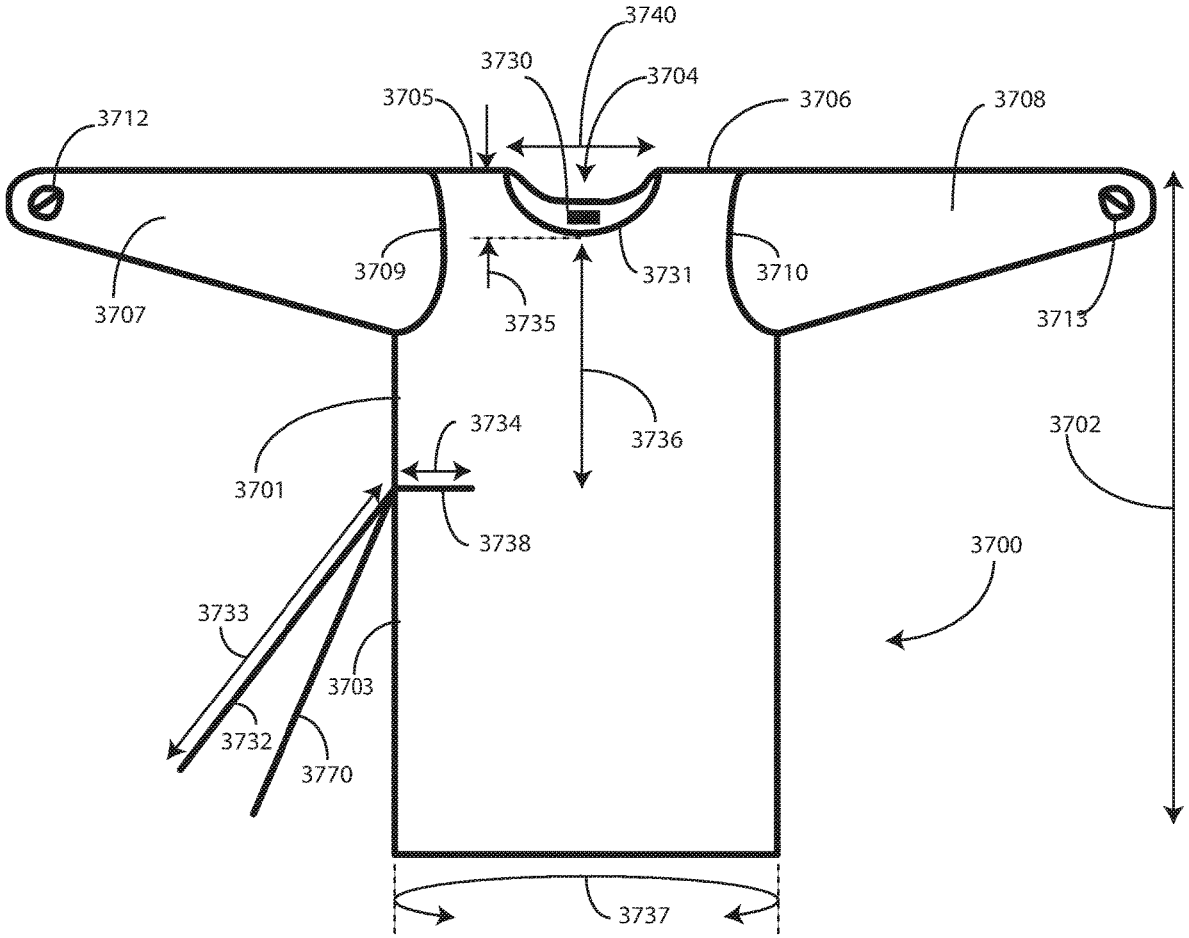
FIG. 37 illustrates a front view of another example of a gown configured in accordance with one or more embodiments of the invention.
Figure 38:
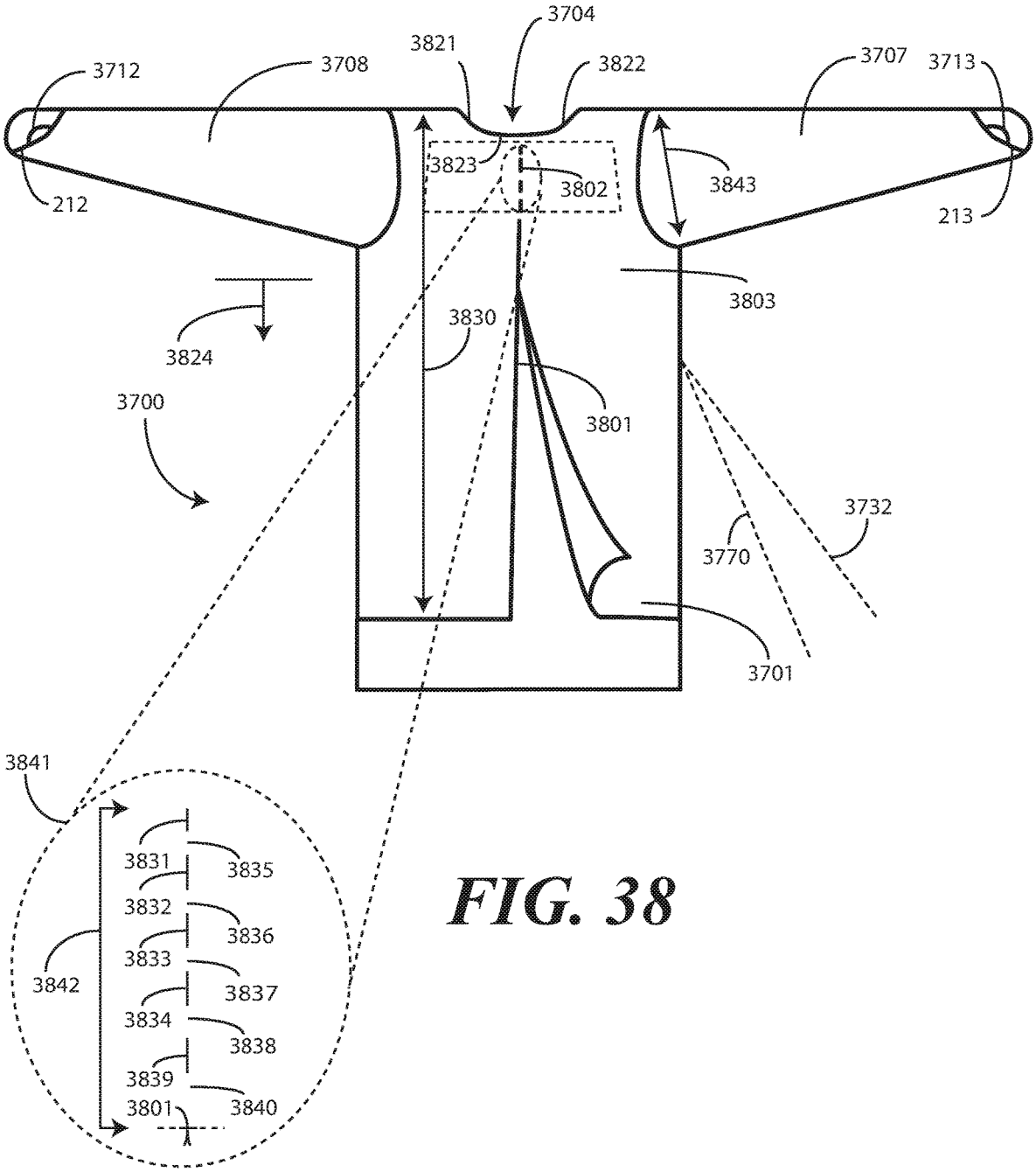
FIG. 38 illustrates a rear view of another example of a gown configured in accordance with one or more embodiments of the invention.

Turning now to FIGS. 37 and 38, illustrated therein is yet another example of a medical gown 3700 configured in accordance with one or more embodiments of the invention. A body covering portion 3701 is configured to wrap about the torso of a wearer. The body covering portion 3701, in one embodiment, is manufactured from a single, unitary layer of non-woven fabric. The body covering portion 3701 of FIG. 37 differs from the body covering portion (101) of FIG. 1 in that it is substantially rectangular when viewed from a plan perspective. Other elements of the body covering portion 3701 of FIG. 37 can be the same as that of FIG. 1. For example, the body covering portion 3701 of FIG. 1 can be manufactured from a single, unitary layer of non-woven fabric. The non-woven fabric can be a disposable material, and optionally can include and water resistant lining that prevents the passage of fluids through the body covering portion 3701.

In one embodiment, the length 3702 of the medical gown 3700 is configured to run from a wearer's shoulder to below their knee. In a "regular" size, this length 3702 can be between 48.50" and 50.50" in one embodiment. For an "extra large" size, this length 3702 can be between 51.00" and 53.00" in one embodiment. Other dimensions will be obvious to those of ordinary skill in the art having the benefit of this disclosure.

In one embodiment, the gown 3700 may optionally include pockets or other surface features. The gown 3700 may be manufactured in various colors. In one embodiment, the gown 3700 is yellow due to its high visibility and easy differentiation from a patient's skin. In another embodiment, the gown 3700 is white. A label 3730 can be included and can also be color-coded. For example, in one embodiment the label 3730 is white with blue text to indicate that the gown 3700 is "regular size," while in another embodiment the label 3730 is blue with white text to indicate the "extra large" size. In one embodiment, the label 3730 measures about 1.25" square to facilitate easy readability.

The body covering portion 3701 includes a front portion 3703 and a rear portion 3803. The front portion 3703 is configured as a frontal body covering portion in that it is configured to cover the frontal portion of some or all of a user's body, or in another embodiment the frontal portion of some or all of a user's torso, when the user is wearing the gown. The body covering portion 3701 further includes a rear portion 3803 that is configured to cover at least a portion of a wearer's shoulder blades. In the illustrative example of FIGS. 37 and 38, the rear portion 3803 has a shorter length than the front portion 3703, although this is but one configuration for one embodiment. In another, the front portion 3703 will be substantially the same length as the rear portion 3803, and so forth. In this illustrative embodiment, the length 3830 of the rear portion 3803 is between 39.00" and 41.00" for the regular size gown, and between 41.00" and 43.00" for the extra large size. In other embodiments, the front portion 3703 may be shorter than the rear portion 3803, thereby covering less of the wearer's body in the front than in the rear.

In one embodiment, the body covering portion 3701 defines a head insertion aperture 3704 through which a user may insert their head when donning the gown. In the illustrative embodiment of FIGS. 37 and 38, the head insertion aperture 3704 is disposed between the front portion 3703 and the rear portion 3803, and is surrounded by shoulder portions 3705,3706 of the body covering portion 3701. In one or more embodiments, the shoulder portions 3705,3706, as well as other seams of the gown 3700, can be formed by ultrasonically sealing the front portion 3703 and the rear portion 3803 together. The perimeter of the head insertion aperture 3704 can take a variety of shapes. For example, in the illustrative embodiment of FIGS. 37 and 38, the front 3731 of the head insertion aperture 3704 is substantially partially circular, extending a distance 3735 of between about 4.00" and 5.00" for the regular size and between about 4.50" and 5.50" for the extra large size, while the rear of the head insertion aperture 3704 has an angle-tapered flat contour, with two angular side edges 3821,3822 radially interfacing with a substantially flat contour 3823. In one embodiment, the width 3740 of the head insertion aperture 3704 is between about 9.00" and 10.00" for the regular size and between about 9.50" and 10.50" for the extra large size. Other embodiments described below may include different heat insertion aperture contours and sizes.

In one embodiment, the body covering portion 3701 defines an opening 3801. The front portion 3703 of the gown 3700 is configured, in one embodiment, to be placed against the front of the torso of a wearer. The body covering portion 3701 then wraps around and terminates at the opening 3801. The opening 3801 in this embodiment has a left side and a right side, and is configured as a slit that runs most of the length 3830 of the rear side 3803 of the back of the medical gown 3700.

The opening can be used to assist in donning the gown. For instance, a user may open the opening 3801 and pass their head, shoulders, and/or torso portions through the opening 3801 when donning the gown. Said differently, the right side and left side of the opening 3801 can be configured to permit the wearer to don the gown 3800 by wrapping the right side and left side of the body covering portion 3701 about the wearer's torso. In the illustrative embodiment of FIGS. 37 and 38, the opening 3801 is disposed on a side 3824 of the rear portion 3803 opposite the head insertion aperture 3704. The opening 3801 then extends distally from the rear portion 3803 to a base of the body covering portion 3701.

In one embodiment, the gown 3700 includes one or more progressive perforations 3802. In FIGS. 37 and 38, the progressive perforations 3802 are considered to be "progressive" in that the length of each cut, as well as the distance between each cut, is non-uniform. The progressive perforations 3802 extend across the rear portion 3803, at least partially between the opening 3801 and the head insertion aperture 3704. The progressive perforations 3802 can assist the user in removing the gown 3700 by providing a score line that can be easily torn. A user can therefore easily remove the gown 3700 by simply tearing the progressive perforations 3802 and pulling the gown 3800 off.

In one embodiment, the progressive perforations 3802 comprise a plurality of scores 3831,3832,3833,3834,3839 as shown in the magnified perforation view 3841. Each of the scores 3831,3832,3833,3834,3839 is separated by a corresponding length 3835,3836,3837,3838 of material. Further, the lowest score line 3839 is separated from the opening 3801 by a length of material 3840. In one embodiment, the lengths of these scores 3831,3832,3833,3834,3839 and corresponding lengths 3835,3836,3837,3838,3840 are non-uniform. For example, in one embodiment score 3831 is about 0.25" long, while scores 3832,3833,3834,3839 all have a length of about 1.00". Similarly, in one embodiment lengths 3835,3836,3837 are all about 0.25" in length, while score 3838 is about 0.50" in length and length 3840 is about 1.50" in length. While the configuration of the progressive perforations 3802 can take a variety of configurations, the illustrative configuration of FIGS. 37 and 38 can bee more suited to easy removal of the gown 3700 than others. An overall length 3842 of the progressive perforations 3802 can be between about 6.50" and 7.50" in one embodiment. While progressive perforations 3802 are one example of the way that the scores can be configured, others will be obvious to those of ordinary skill in the art having the benefit of this disclosure. For example, the scores shown in the magnified perforation view (230) of FIG. 2 could be used on the gown 3700 instead of the progressive perforations 3802 in another embodiment.

In one embodiment, to further assist the user in removing the gown, the non-woven fabric is configured so as to be tearable by a wearer. For example, to non-woven fabric may have a tensile strength of between four and ten pounds. Thus, if a user were to grasp opposing sides of a section of the non-woven fabric, and then pull with a force of between four and ten pounds, the fabric would tear. Accordingly, in one embodiment a user can remove the gown by tearing the non-woven fabric. Accordingly, a non-woven fabric that is easily tearable by a wide range of wearers, e.g., male and female wearers, may be selected for construction of the medical gown 3700 in accordance with such an embodiment.

In one embodiment, a first sleeve 3707 and a second sleeve 3708 extend distally from the body covering portion 3701. The first sleeve 3707 and the second sleeve 3708 are configured to receive wearer's arms when the medical gown 3700 is donned. In one embodiment, each of the first sleeve 3707 and the second sleeve 3708 are configured as single, unitary pieces of non-woven fabric that are attached with the body covering portion 3701 at a seams 3709,3710. The seams 3709,3710 can be sewn, although in this illustrative embodiment they are formed by ultrasonic welding the sleeves 3707,3708 to the body covering portion 3701. Other attachment methods, including adhesive bonding, mechanical or press-fit bonding, thermal bonding, and so forth, will be obvious to those of ordinary skill in the art having the benefit of this disclosure. In one embodiment, the sleeve width 3843 at the seams 3709,3710 is between about 11.50" and 12.50" for the regular size and between about 12.50" and 13.50" for the extra large size.

As with previous embodiments, the medical gown 3700 has sleeves 3707,3708 that each terminate in a thumb loop. In one embodiment, the thumb loop comprises a thumb insertion aperture 3712,3713, through which a wearer's thumb may be inserted. In one embodiment, the thumb loop further comprises a hand saddle curvature termination 3812, 3813. In this embodiment, the hand saddle curvature terminations 3812,3813 back the thumb insertion apertures and can be seen therethrough when the sleeves 3707,3708 are pressed flat. The backing of the thumb insertion apertures 3712,3713 by hand saddle curvature terminations 3812,3813 that work to permit the heel of a wearer's hand to be exposed when the thumb is inserted into the thumb insertion aperture 3712,3713. The thumb loops, where included, provide several functions. One illustrative function is that they keep the sleeves 3707,3708 pulled along the wearer's arms and prevent the sleeves 3707,3708 from "riding up." Another illustrative function is that the thumb loops prevent twisting of the sleeves 3707,3708 about the wearer's arm. Each thumb loop is configured, in one embodiment, to engage the saddle of a thumb of the wearer.

In one embodiment, the medical gown 3700 includes one or more ties 3732 that can be tied together to close the opening 3801. For example, one tie 3732 can be provided shown on one of the medical gown 3700 that wraps completely around the wearer. In another embodiment, a second tie 3770 can attach to the medical gown 3700 at a common connection point with the first tie 3732. When a wearer dons the medical gown 3700, they can wrap the first tie 3732 around the front of their torso and the second tie 3770 around the back, tying the first tie 3732 and the second tie 3770 together on the left side of their torso. In yet another embodiment, a second tie can be attached as a mirror image of tie 3732 on the left side of the medical gown 3700 as well.

In one embodiment, the one or more ties 3732 have a length 3737 of about 66.00", minimum for a regular size, and about 76.00", minimum, for the extra large size. These lengths facilitate a body covering portion 3701 having a sweep 3737 of between about 56.00" and 60.00" for the regular size and between about 60.00" and 64.00" for the extra large size. Each of the one or more ties 3732 can be affixed to the body covering portion 3701 with a side tie attachment 3738, which may be formed by ultrasonically welding the one or more ties 3732 to the body covering portion, and that has a length 3734 of between about 3.00" and 5.00". In one embodiment, the side tie attachment 3738 is disposed a distance 3736 of between about 17.00" and 18.00" below the front 3731 of the head insertion aperture 3704 for the regular size, and between about 18.00" and 19.00" below the front 3731 of the head insertion aperture 3704 for the extra large size.

In the foregoing specification, specific embodiments of the present invention have been described. However, one of ordinary skill in the art appreciates that various modifications and changes can be made without departing from the scope of the present invention as set forth in the claims below. Thus, while preferred embodiments of the invention have been illustrated and described, it is clear that the invention is not so limited. Numerous modifications, changes, variations, substitutions, and equivalents will occur to those skilled in the art without departing from the spirit and scope of the present invention as defined by the following claims. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims.

What is claimed is:

1. A gown, comprising:

a non-woven fabric layer defining a neck opening between a front portion and a rear portion, wherein the rear portion defines an opening configured as a slit with sides that abut and configured to assist a user in donning the gown;

one or more perforations extending across the rear portion at least partially between the opening and the neck opening, the one or more perforations to tear and split the rear portion when the front portion is pulled away from the user;

one or more sleeves extending distally away from an intersection of the front portion and the rear portion, each sleeve defining an arm insertion aperture and terminating at a thumb loop configured to engage a saddle of a thumb of the user; and one or more tie members, attached to the non-woven fabric layer;

wherein the opening is closable when the one or more tie members are tied together about an exterior of the gown.

2. The gown of claim 1, wherein the one or more tie members comprise a first tie member and a second tie member affixed to the gown at tie attachments.

3. The gown of claim 1, the one or more tie members comprising a first tie and a second tie.

4. The gown of claim 3, the first tie attached to the non-woven fabric layer at a separate connection point from the second tie.

5. The gown of claim 4, the first tie to wrap around a rear exterior of the gown.

6. The gown of claim 5, the second tie to also wrap around the rear exterior of the gown.

7. The gown of claim 3, the first tie attached to a right side of the gown, the second tie attached to a left side of the gown.

8. The gown of claim 7, the second tie a mirror image of the first tie.

9. The gown of claim 7, the first tie attached to the right side of the gown at a hip region, the second tie attached to the left side of the gown at another hip region.

10. The gown of claim 1, a front portion length of the front portion greater than a rear portion length of the rear portion.

11. The gown of claim 1, wherein the one or more perforations comprises a plurality of scores separated by lengths of material.

12. The gown of claim 11, wherein the plurality of scores are each about one inch long, further wherein the lengths of material are each about one half inch long.

13. The gown of claim 11, wherein the plurality of scores comprises four scores.

14. The gown of claim 11, wherein the plurality of scores are each about three-quarters of an inch long, further wherein the lengths of material are each about one quarter inch long.

15. The gown of claim 1, wherein the non-woven fabric layer is white.

16. The gown of claim 1, wherein the non-woven fabric layer is yellow.

17. A disposable medical gown, comprising:

a body covering portion defining a frontal body covering portion and a rear portion, the body covering portion defining an opening along the rear portion;

one or more tie members extending from the body covering portion;

one or more perforations extending across the rear portion at least partially between the opening and a head insertion aperture, with all perforations of the one or more perforations arranged in a linear score line, the one or more perforations to tear when the frontal body covering portion is pulled away from a wearer, thereby splitting the rear portion; and one or more sleeves extending distally away from the body covering portion, each sleeve defining an arm insertion aperture and terminating at a thumb loop configured to engage a saddle of a thumb of the wearer, the each sleeve extending a distance between the thumb loop and the body covering portion;

the opening being closable when the one or more tie members are tied together about a rear portion of the gown.

18. The disposable medical gown of claim 17, the one or more tie members comprising a first tie member and a second tie member.

19. The disposable medical gown of claim 18, the first tie member attached to the body covering portion at a connection point separated by the frontal body covering portion from another connection point where the second tie member is attached to the body covering portion.

20. The disposable medical gown of claim 17, wherein the linear score line and a slit defined by the opening are collinear.

* * * * *